US006267149B1

(12) United States Patent
Yasui et al.

(10) Patent No.: US 6,267,149 B1
(45) Date of Patent: Jul. 31, 2001

(54) APPARATUS FOR INSERTING CONNECTION YARN INTO THREE-DIMENSIONAL FABRIC

(75) Inventors: Yoshiharu Yasui; Junji Takeuchi; Fujio Hori; Masaaki Amano, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/533,839

(22) Filed: Mar. 23, 2000

(30) Foreign Application Priority Data

Mar. 26, 1999 (JP) ..... 11-083827

(51) Int. Cl.[7] ..... D03D 41/00
(52) U.S. Cl. ..... 139/11; 139/DIG. 1
(58) Field of Search ..... 139/11, DIG. 1

(56) References Cited

U.S. PATENT DOCUMENTS

| | | | | |
|---|---|---|---|---|
| 4,095,619 | * | 6/1978 | Kallmeyer | 139/22 |
| 4,183,993 | * | 1/1980 | Benstead et al. | 442/314 |
| 5,327,621 | * | 7/1994 | Yasui et al. | 28/149 |
| 5,720,320 | * | 2/1998 | Evans | 139/11 |
| 5,772,821 | * | 6/1998 | Yasui et al. | 156/93 |
| 5,833,802 | * | 11/1998 | Yasui et al. | 156/510 |

FOREIGN PATENT DOCUMENTS

| | | | | |
|---|---|---|---|---|
| 8-218249 | | 8/1996 | (JP) . | |
| 10-325043 | | 12/1998 | (JP) . | |
| 00/29659 | * | 5/2000 | (WO) | D05B/23/00 |

* cited by examiner

*Primary Examiner*—John J. Calvert
*Assistant Examiner*—Robert H. Muromoto, Jr.
(74) *Attorney, Agent, or Firm*—Morgan & Finnegan, LLP

(57) ABSTRACT

A connection yarn inserting apparatus for manufacturing three-dimensional fabric. The apparatus inserts connection yarns into a lamination of fiber layers in a direction transverse to each fiber layer. The apparatus has insertion needles for inserting connection yarns into the lamination. The insertion needles are moved between a standby position, where the needles are separated from the lamination, and an operational position, where the needles penetrate the lamination. The lamination is clamped by a pair of opposed pressing members. The pressing members are operated by air cylinders. A stopper can be moved into and away from the moving range of the piston rod of each of the air cylinders. The stopper is actuated by an actuator. When the stoppers in the moving range of the associated piston rod, the stopper limits the stroke of the piston rod. This reduces the time necessary to move the associated piston rod and increases productivity.

15 Claims, 16 Drawing Sheets

APPARATUS FOR INSERTING CONNECTION YARN INTO THREE-DIMENSIONAL FABRIC

BACKGROUND OF THE INVENTION

The present invention relates to an apparatus for inserting connection yarns into a three-dimensional fabric, and more particularly to an apparatus for simultaneously inserting a plurality of connection yarns into a fiber lamination. Specifically, the apparatus is used to manufacture a fiber lamination that is folded in at least two directions and has connection yarns that extend perpendicularly to each layer of the lamination.

Japanese Unexamined Patent Publication No. 8-218249 discloses a method for manufacturing a three-dimensional fabric. In this method, pins are provided with a predetermined pitch between one another on a frame to surround an area where connection yarns are inserted into a fiber lamination. Fiber layers are formed by folding back fibers at each pin to form a lamination. A row of insertion needles insert connection yarns, which are perpendicular to the lamination, into the lamination.

Connection yarns are typically inserted into a lamination in the following manner. A frame holding the lamination is first secured to a support table. The support table is moved by a predetermined pitch such that the lamination passes the movement range of connection yarn insertion needles. When insertion of the connection yarns in a predetermined area of the lamination is completed, the frame, together with the lamination, is removed from the support table. Then, another table to which a lamination is attached is fixed to the support table. Connection yarns are then inserted into the new lamination.

When inserting connection yarns into a lamination, a row of first needles, to each of which a connection yarn is engaged, are inserted into the lamination. After the needles penetrate the lamination and the needle eyes are located at the opposite side of the lamination from the standby position of the insertion needles, the needles are slightly retracted. This forms a yarn loop at the distal end of each insertion needle at the opposite side of the lamination. A second needle to which a lock yarn is engaged is reciprocated such that the lock yarn is inserted into each loop. The first needles are pulled back in this state, which tightens the lamination and prevents the connection yarns from being loosened. The second needle has a latch at its distal end and is reciprocated by a driving device. The driving device is generally an air cylinder or a lead screw mechanism, which is actuated by a servomotor.

Three-dimensional fabrics are typically used to form a frame member of a composite. The strength of such composite largely depends on the properties of the three-dimensional fabric. To increase the strength of the composite, the density of the fiber (lines) in the fabric must be increased and the lines must be orderly. Accordingly, laminations must be tightly bundled by connection yarns and the tightening force of the connection yarns must be equalized.

Japanese Unexamined Patent Publication No. 10-325043 discloses a connection yarn supplying apparatus having a tension adjusting means and a brake means. The tension adjusting means includes two stationary rollers and a movable roller. The stationary rollers are located at predetermined positions and are perpendicular to the inserting direction of the connection yarns. The movable roller is supported by a pivotable support arm and is parallel to the stationary rollers. The support arm is actuated by an air cylinder. the connection yarn is bent and held between the stationary rollers and the movable roller. To control the tension of a connection yarn, the brake means is first activated. The air cylinder then applies a force in a predetermined direction to the support arm to tension the connection yarn. The tension of the connection yarn is controlled by adjusting the pressure of air in the air cylinder.

A three-dimensional fabric may be manufactured by inserting connection yarns into a lamination that is supported only by a frame. However, the process of inserting and removing needles is likely to loosen the fibers of the lamination, which degrades the characteristics of the material when a composite is formed from the lamination. The apparatus of the publication No. 8-218249 has an apparatus for overcoming this drawback. That is, the apparatus of the publication has first and second pressing members to sandwich a lamination in the vicinity of the inserting area of the row of first needles. Connection yarns are inserted into the lamination while the pressing members are holding the laminate. The first and second pressing members are moved between an operation position and a standby position. When at the operational position, the pressing members hold the lamination. When at the standby position, the pressing members do not engage the laminate.

A three-dimensional fabric with high density is obtained by setting the pitch of the connecting yarns to three millimeters. Therefore, if the length of a lamination is sixty centimeters and the pitch of the connection yarns is three millimeters, there will be two hundred insertion cycles. The above described apparatuses include air cylinders and lead screw mechanisms. A lead screw mechanism is actuated by a servomotor. The first needles, the position of which must be relatively accurately determined, and the second needle, which is moved by a relatively great distance, are actuated by lead screw mechanism. The tension adjusting means and first and second pressing members, which requires a pressure control, are actuated by air cylinders.

However, if an air cylinder is used for moving a member, it is difficult to increase the moving speed while maintaining the applied pressure. While inserting connection yarns into a lamination, the pressing members must be separated from the lamination when the lamination is moved by a predetermined pitch. When moving the lamination by the predetermine pitch, the separation distance between the lamination and the pressing members may be a minimum distance. However, since the lamination is secured to the frame by the support pins, if the pressing members are retracted by the minimum distance when setting the frame on a predetermined position of the yarn inserting apparatus, the pins interfere with the pressing members. Therefore, the standby position of the pressing members is separated from the lamination such that the pressing members do not interfere with the support pins. As a result, the moving distance of the pressing members is increased, which extends the time required for inserting connection yarns. Accordingly, productivity is lowered.

The movable roller of the tension adjusting means for connection yarns is supported by the support arm. The support arm is actuated by an air cylinder. The support arm therefore cannot be moved quickly, which also lowers productivity.

The apparatuses of the publications can process only be one frame of lamination at a time. Therefore, the insertion of connection yarns must be prepared every time a new frame is set in the apparatus. Specifically, the end of each connection yarn, which is inserted in the corresponding first needle, must be fixed to the frame, which increases the time required for manufacturing three-dimensional fabric. Productivity is lowered accordingly.

The second needle for a lock yarn is actuated by the lead screw mechanism, which is actuated by a servomotor. The moving speed of the lock yarn needle is therefore not as fast as desired. Thus, there is a demand for a lock yarn needle that moves faster to improve productivity.

SUMMARY OF THE INVENTION

Accordingly, it is an objective of the present invention to provide a connection yarn inserting apparatus that shortens the time required for inserting connection yarns when manufacturing three-dimensional fabrics to improve productivity.

To achieve the foregoing and other objectives and in accordance with the purpose of the present invention, a connection yarn inserting apparatus for manufacturing three-dimensional fabric is provided. The apparatus inserts a connection yarn into a lamination, which is formed by laminating a plurality of fiber layers and has fibers extending in at least two different directions, in a direction transverse to the fiber layers. The apparatus includes a frame for holding the lamination, a needle for inserting the connection yarn into the lamination held by the frame, a first pressing member located at the same side of the lamination as the standby position of the insertion needle, a first air cylinder for moving the first pressing member between an operational position, a second pressing member located at the opposite side of the lamination relative to the first pressing member, a second air cylinder for moving the second pressing member between an operational position, a stopper that is engageable with a piston rod of at least one of the first and second air cylinders, and an actuator for actuating the stopper. The insertion needle moves in an advancement direction and a retraction direction between a standby position, where the insertion needle is separated from the lamination, and an operation position, where the insertion needle penetrates the lamination. The first pressing member is moved in the moving direction of the insertion needle to and from the vicinity of an insertion location of the insertion needle. The first pressing member engages the lamination in the vicinity of an insertion location of the insertion needle and presses the lamination in the advancing direction of the insertion needle, and a standby position, where the first pressing member is separated from the lamination. The second pressing member is moved in the moving direction of the insertion needle to and from the vicinity of the insertion location of the insertion needle. The second pressing member engages the lamination and presses the lamination in the retraction direction of the insertion needle, and a standby position, at which the second pressing member is separated from the lamination. When the stopper is engaged with the piston rod, the stopper limits the movement of the piston rod in the retraction direction to directly vary the stroke of the piston rod and the corresponding pressing member.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 1(*b*) is an enlarged partial cross-sectional view showing a coupling portion of a carrier table;

FIG. 2(*b*) is an enlarged partial view showing a wheel of the table of FIG. 2(*a*);

FIG. 3(*b*) is an enlarged partial view showing the brake means of FIG. 3(*a*);

FIG. 13(*b*) is a plan view showing a supporting state of the rod fixing member;

FIG. 13(*c*) is an enlarged partial view of FIG. 12;

FIG. 18(*c*) is diagrammatic view for showing the operation of the lock yarn insertion needle according to first embodiment.

DETAILED DESCRIPTION OF THE PREFERRED EMBODIMENTS

A first embodiment according to the present invention will now be described with reference to FIGS. 1 to 17(*b*).

Figure 1:
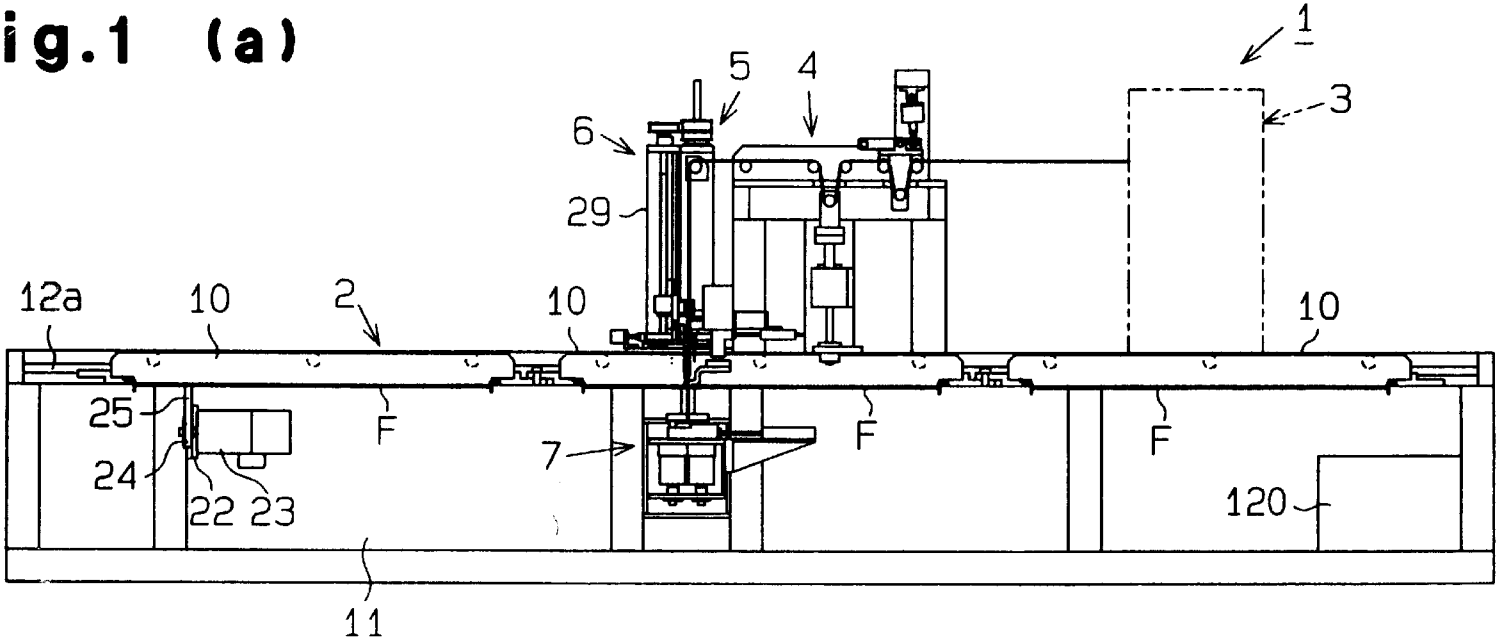
FIG. 1(*a*) is a diagrammatic side view illustrating a connection yarn inserting apparatus according to a first embodiment.
Figure 1:
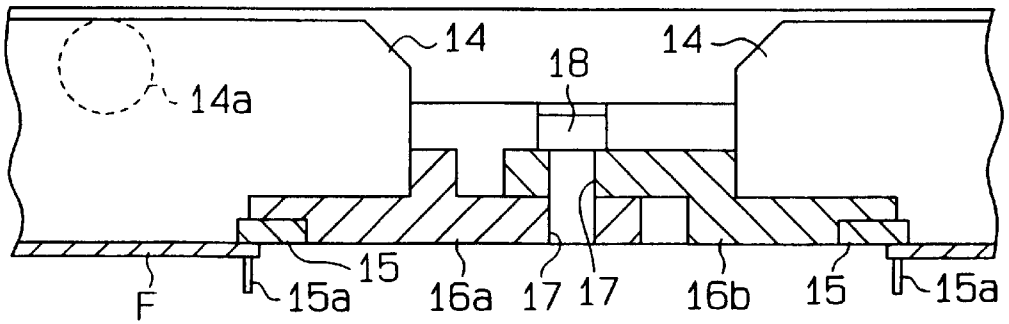
Figure 2:
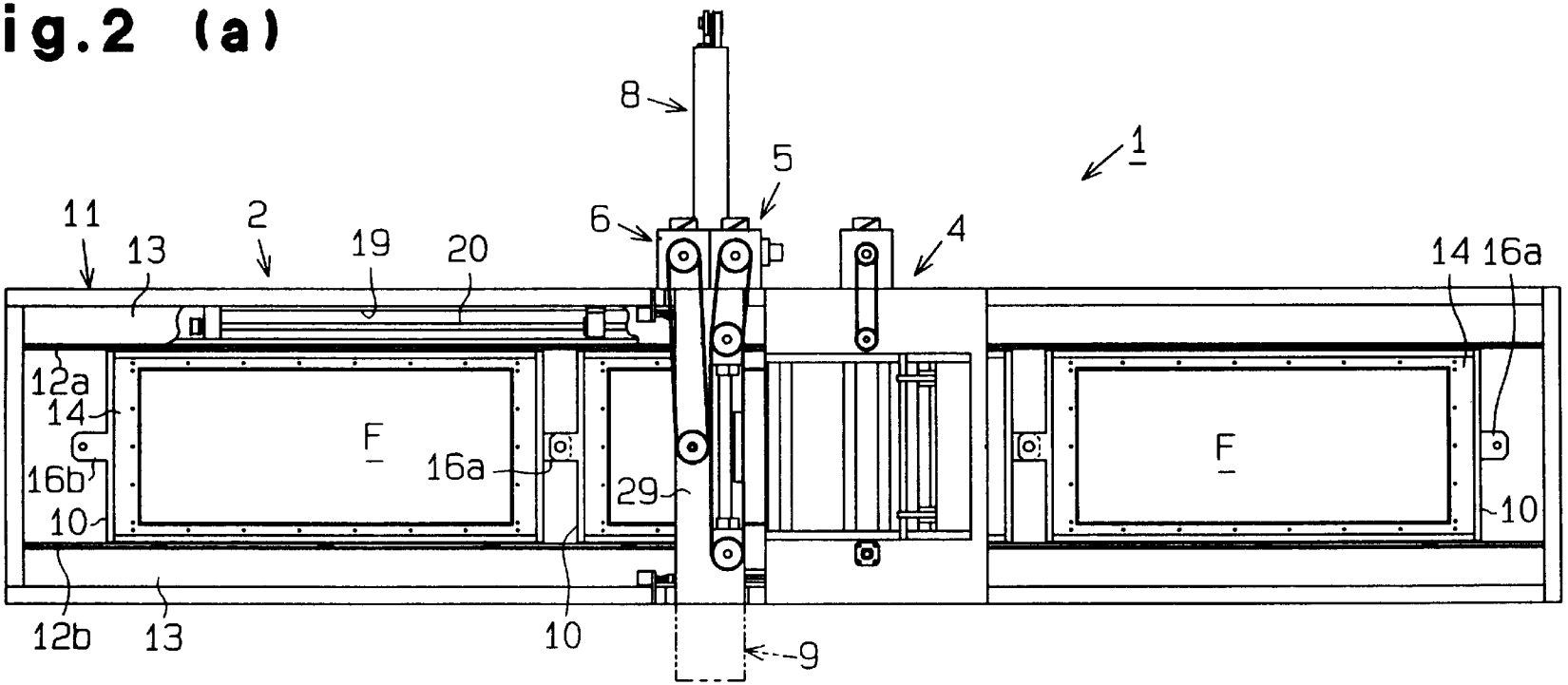
FIG. 2(*a*) is a diagrammatic plan view showing the apparatus of FIG. 1(*a*)
Figure 2:
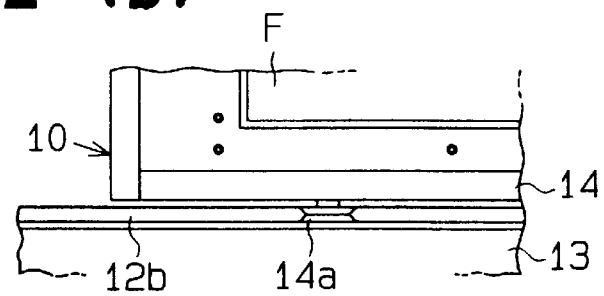

As shown in FIGS. 1(*a*) and 2(*a*), a connection yarn inserting apparatus 1 includes a lamination conveying mechanism 2, a first feeding mechanism 3 (see FIG. 1(*a*)) for connection yarns, a connection yarn tension applying mechanism 4, a first actuation mechanism 5 for inserting perforation needles, a second actuation mechanism 6 for inserting connection yarn needles, a lamination pressing mechanism 7, a lock yarn inserting mechanism 8 and a second feeding mechanism 9 for feeding lock yarn (only shown in FIG. 2).

Carrier tables 10, the number of which is three in this embodiment, are located on the conveying mechanism 2. Each carrier table 10 supports a lamination F. The structure of the connection yarn feeding mechanism 3 is similar to that of Japanese Unexamined Patent Publication No. 10-325043. That is, the feeding mechanism 3 transmits the rotation of motors to bobbins, about each of which a connection yarn z is wound, through a sliding transmission means. Accordingly, each bobbin feeds a yarn. Further, the feeding mechanism 3 applies a predetermined tension to each connection yarn z.

Figure 7:
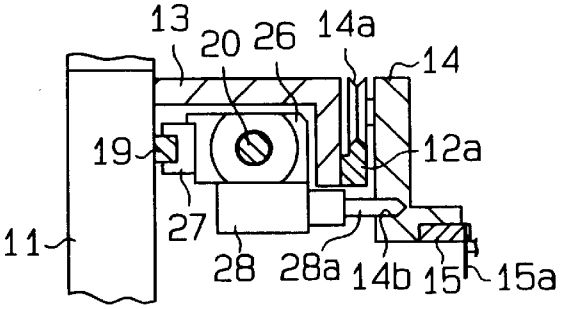
FIG. 7 is an enlarged partial cross-sectional view showing a supporting structure of the carrier table.

As shown in FIGS. 2(*a*), 5 and 6, the lamination conveying mechanism 2 includes support rails 12*a*, 12*b*, which extend in the longitudinal direction of a body frame 11. The rails 12*a*, 12*b* are fixed to the body frame 11 through support brackets 13. Each carrier table 10 includes a table body 14, which is a substantially rectangular frame. Wheels 14*a*, the number of which is six in this embodiment, are attached to the sides of the table body 14. Each carrier table 10 is supported on the rails 12*a*, 12*b* through the wheels 14*a*. The rails 12*a*, 12*b* function as a carrier table guide mechanism for moving the tables 10 in the direction of the row of the tables 10. The rails 12*a*, 12*b* have pointed cross-section as shown in FIG. 7. Each wheel 14*a* has a V-shaped groove to engage the rails 12*a*, 12*b*.

A frame 15 is attached to the table body 14 by removable fasteners such as bolts. The frame 15 includes support pins 15*a* to support the lamination F. Each table body 14 includes rear and front couplers 16*a*, 16*b*. Each coupler 16*a*, 16*b* is connected to a mating coupler 16*b*, 16*a* to connect a pair of adjacent carrier tables 10. As shown in FIGS. 1(*b*), 3(*a*) and 5, each rear coupler 16*a* is located at the rear end of the corresponding table body 14, and each front coupler 16*b* is located at the front end of the corresponding table body 14. The couplers 16*a*, 16*b* are formed such that the front coupler 16*b* is located over the corresponding rear coupler 16*a*. Each coupler 16*a*, 16*b* has a hole 17, which is aligned with the hole of the mating coupler 16*b*, 16*a*. A coupler pin 18 is fitted in the aligned holes 17 to couple an adjacent pair of carrier tables 10. FIG. 1(*b*) is an enlarged cross-sectional view showing a pair of the couplers 16*a*, 16*b*.

Figure 5:
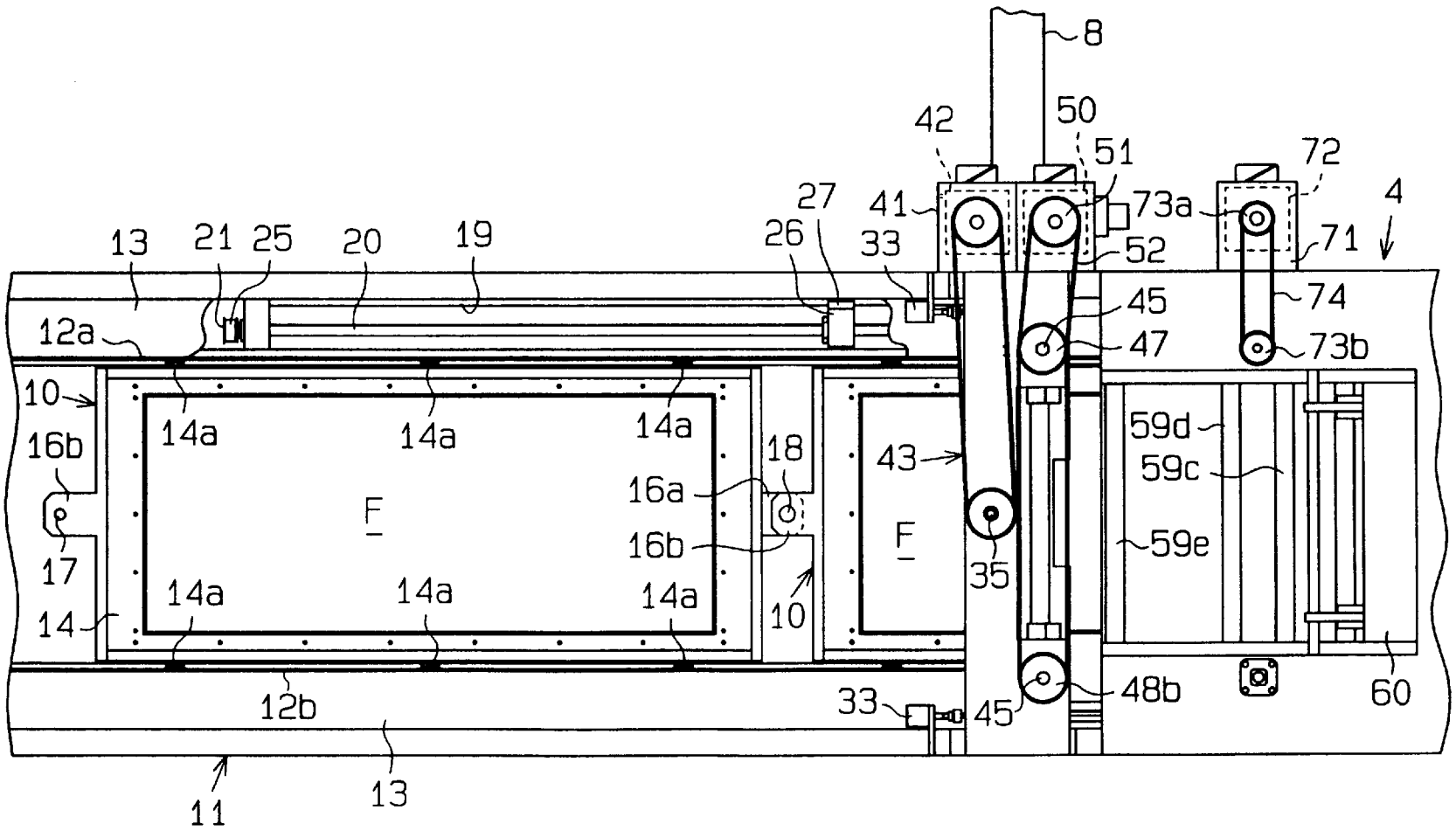
FIG. 5 is an enlarged partial plan view showing the apparatus of FIG. 1(*a*)
Figure 6:
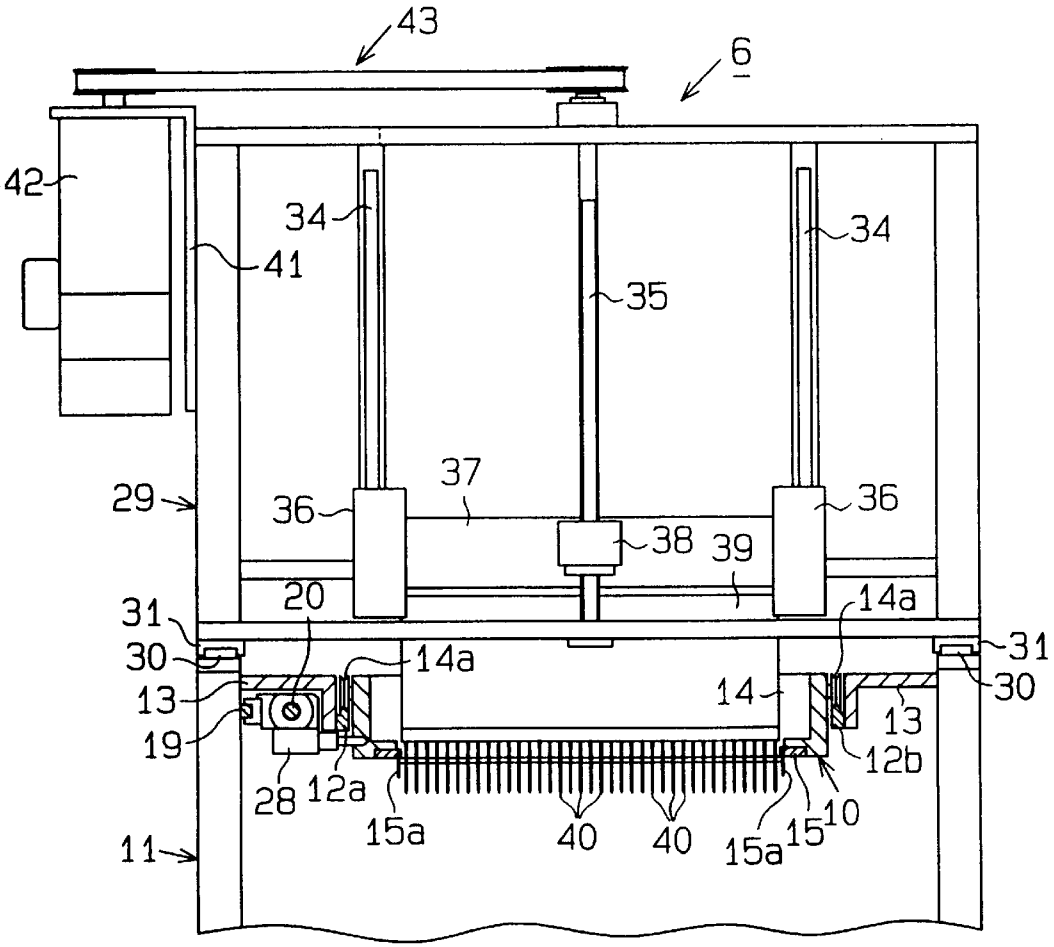
FIG. 6 is a diagrammatic front view showing an actuation mechanism for connection yarn insertion needles of the apparatus shown in FIG. 1(*a*)

As shown in FIGS. 5, 6 and 7, the body frame 11 includes a guide rail 19 to correspond to the left support rail 12*a*. The guide rail 19 extends parallel to the support rail 12*a*. A screw shaft 20 of a lead screw mechanism extends parallel to the guide rail 19. A driven pulley 21 is fixed to an end of the screw shaft 20 (see FIG. 5) to rotate integrally with the shaft 20. A servomotor 23 is attached to the body frame 11 by a bracket 22 as illustrated in FIGS. 1(*a*) and 4. The servomotor 23 is located below the driven pulley 21. A drive pulley 24 is fixed to the drive shaft of the servomotor 23 to rotate integrally with the drive shaft. The drive pulley 24 is coupled to the driven pulley 21 by a belt 25. Therefore, the screw shaft 20 is rotated by the servomotor 23 through the drive pulley 24, the belt 25 and the driven pulley 21.

A lead screw nut 26 of the lead screw mechanism has a guide member 27 at the side facing the guide rail 19. The guide member 27 engages and slides on the guide rail 19. An actuator, which is air cylinder 28 in this embodiment, is located below the guide member 27. A piston rod 28*a* of the air cylinder 28 functions as a coupler. The piston rod 28*a* engages a hole 14*b* formed in the front wall of the table body 14. The hole 14*b* functions as an engagement member. The piston rod 28*a* is moved between an engagement position and a standby position by the air cylinder 28. The piston 28*a* engages the hole 14*b* when at the engagement position and is separated from the hole 14*b* when at the standby position.

The screw shaft 20 is longer than the table body 14. The lead screw nut 26 is moved between a position facing the second actuation mechanism 6 and a position upstream the second actuation mechanism 6. Also, the lead screw nut 26 is moved downstream the second actuation mechanism 6 by a distance greater than the length of the table body 14. When the lead screw nut 26 is moved downstream, the piston rod 28*a* engages the engagement hole 14*b*.

When the servomotor 23 rotates in the forward direction, the screw shaft 20 is rotated to move the lead screw nut 26 to the left as viewed in FIG. 5. In other words, the screw shaft 20 is rotated to move the lead screw nut 26 in the moving direction of the carrier tables 10. When the servomotor 23 is rotated in the reverse direction, the screw shaft 20 is rotated such that the lead screw nut 26 is moved to the right as viewed in FIG. 5. In other words, the screw shaft 20 is rotated such that the lead screw nut 26 approaches the connection yarn feeding mechanism 3. The screw shaft 20, the lead screw nut 26, the air cylinder 28, the driven pulley 21, the drive pulley 24, the belt 25 and the servomotor 23 form a conveying device of the laminations F to move the carrier tables 10 by a predetermined pitch. The conveying device causes the laminations F to consecutively pass the insertion position of the connection yarns z.

As shown in Figs. 1(*a*) and 2(*a*), the first actuation mechanism 5 for perforation needles and the second actuation mechanism 6 for connection yarn needles are located at the approximate center of the body frame 11 adjacent to each other. The second actuation mechanism 6 is located downstream (to the left as viewed in FIG. 1(*a*)) the second actuation mechanism 5 in the moving direction of the carrier tables 10. The actuation mechanisms 5, 6 are located on a movable support frame 29, which moves relative to the body frame 11 in the longitudinal direction of the body frame 11.

Figure 3:
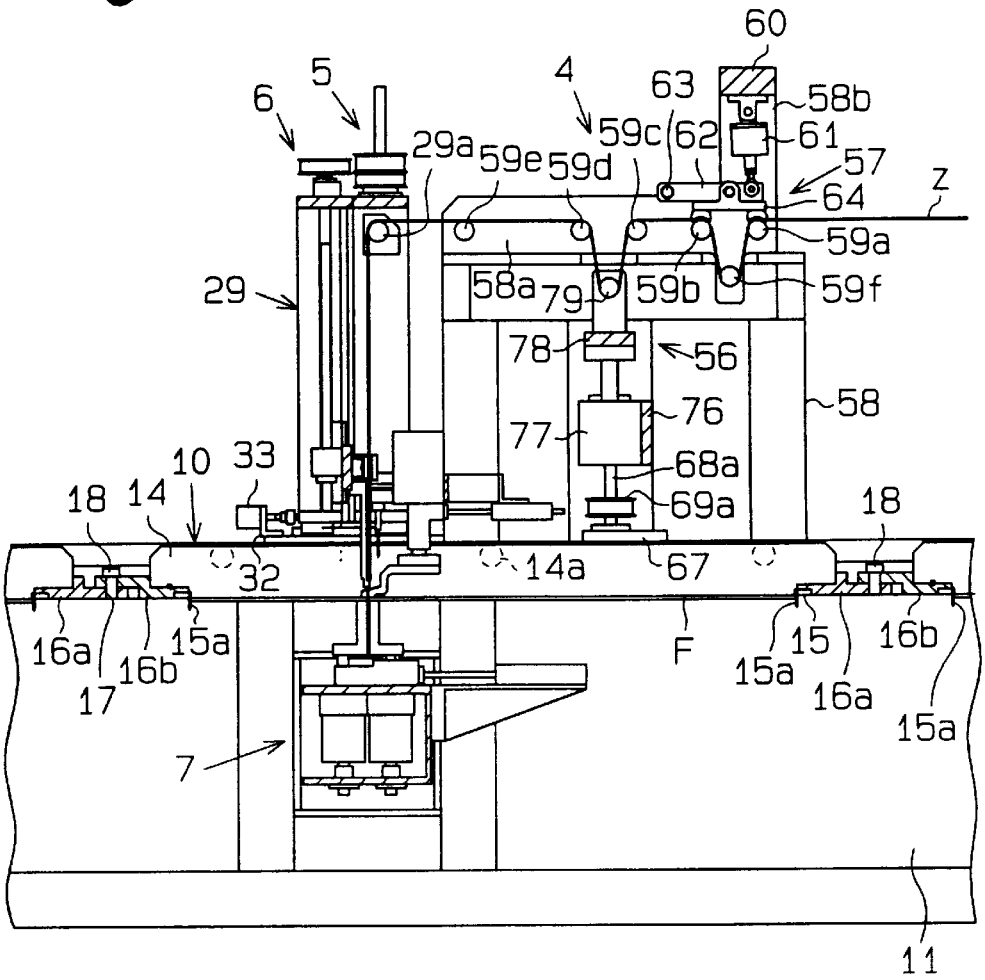
FIG. 3(*a*) is an enlarged partial view of FIG. 1(*a*)
Figure 3:
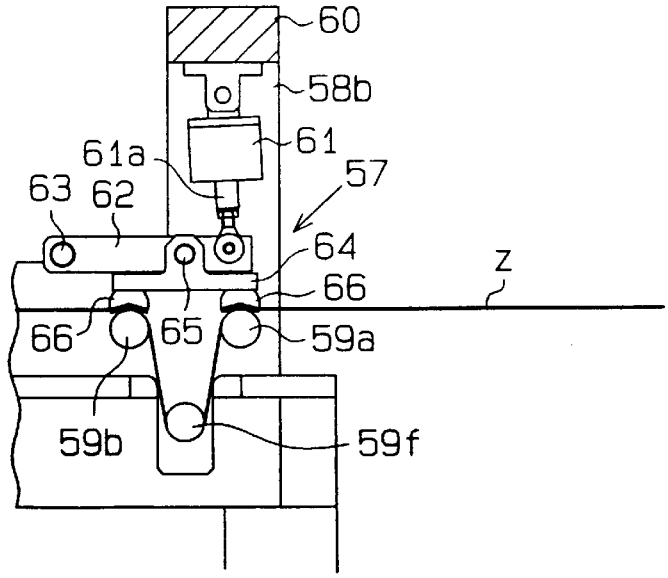
Figure 4:
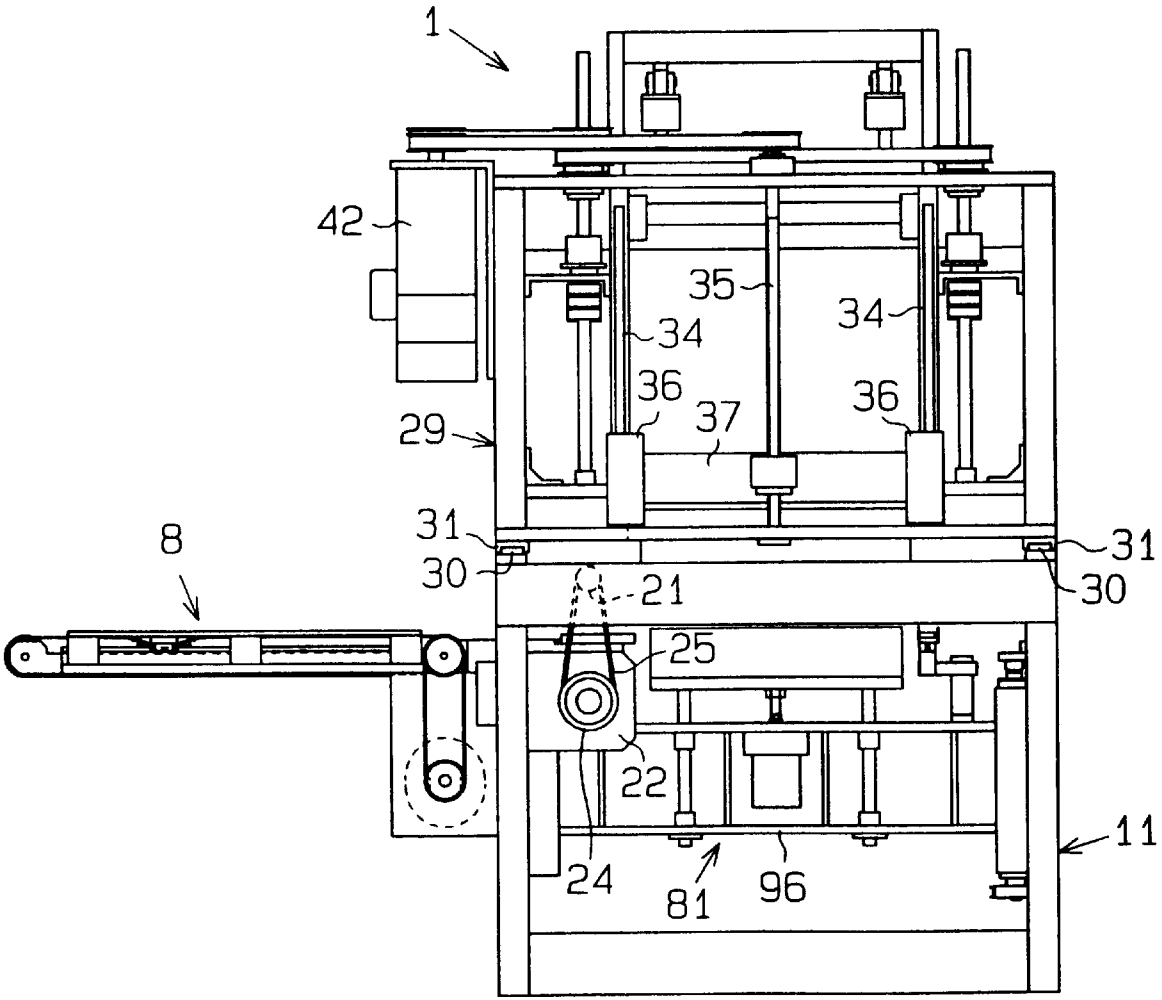
FIG. 4 is a diagrammatic front view illustrating the apparatus of FIG. 1(*a*)
Figure 8:
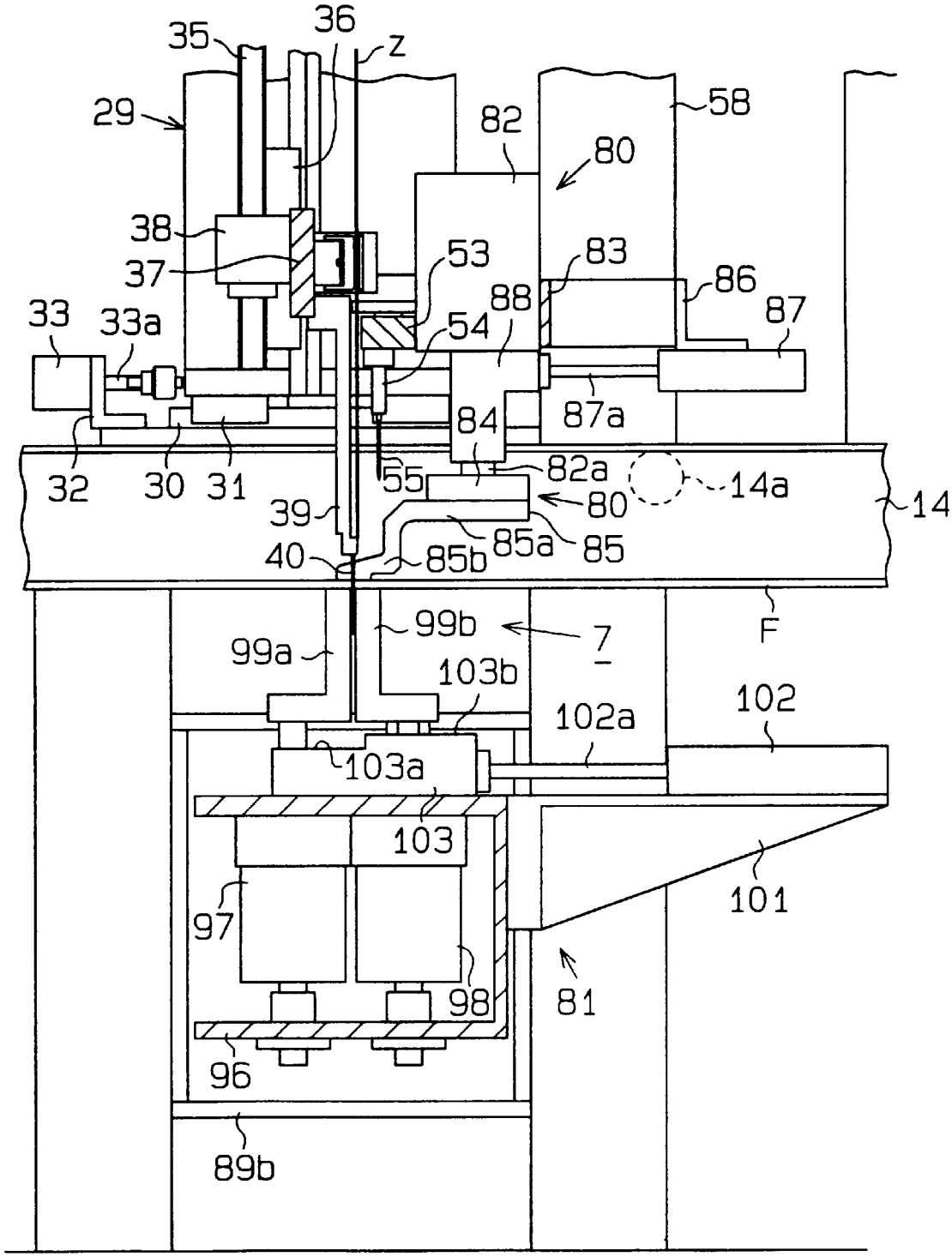
FIG. 8 is an enlarged partial view showing a lamination pressing member of FIG. 3(*a*)

As shown in FIGS. 4 and 6, a pair of rails 30 are fixed on the body frame 11. The movable frame 29 is supported on the rails 30 through linear guide blocks 31 to move relative to the body frame 11. As shown in FIGS. 3(*a*) and 5, a pair of air cylinders 33 are fixed to the body frame 11 by brackets 32. The air cylinders 33 are located in the vicinity of the movable support frame 29 and downstream of the frame 29. As shown in FIG. 8, the movable support frame 29 is coupled to a piston rod 33*a* of each air cylinder 33 and reciprocated by a distance that is equal to the pitch of the perforation needle and the connection yarn insertion needles. FIG. 6 is a diagrammatic front view showing the actuation mechanism 6 for inserting the connection yarn needles. The actuation mechanism 5 for the perforation needles and the tension applying mechanism 4 are not shown in FIG. 6.

The second actuation mechanism 6 includes the movable support frame 29 as illustrated in FIG. 6. A pair of rails 34 are supported by the frame 29 to extend vertically. A screw shaft 35 of a lead screw mechanism is located between the rails 34. The screw shaft 35 is parallel to the rails 34. Each rail 34 has a linear guide block 36. The guide blocks 36 are coupled to each other by a coupler plate 37. The coupler plate 37 has a lead screw nut 38, into which the screw shaft 35 is threaded. As shown in FIG. 8, a needle support 39 is to the coupler plate 37 at the opposite side from the lead screw nut 38. Connection yarn insertion needles 40

(hereinafter referred to insertion needles) are fixed to the needle support 39 and are arranged in a row with a predetermined pitch (for example, one to nine millimeters).

A servomotor 42 is fixed to the upper portion of the sidewall of the movable support frame 29 by a support bracket 41. The servomotor 42 rotates the screw shaft 35 in the forward and reverse directions through a belt transmission mechanism 43. Accordingly, the needle support 39 is moved integrally with the lead screw nut 38 between a standby position and an operational position. At the standby position, the needles 40 do not engage the lamination F, which is supported by the frame 15. At the operational position (see FIG. 6), the needles 40 are inserted into the lamination F such that the needle eyes (not shown) are located at the opposite side of the lamination F. The servomotor 42 rotates the screw shaft 35 such that the insertion needles 40 are moved at an optimum rate when being inserted into the lamination F, when being removed from the lamination F, and when being moved without contacting the lamination F. Specifically, the insertion needles 40 are moved slowly when the needles 40 are contacting the lamination F and quickly when the needles 40 are not contacting the lamination F.

Figure 9:
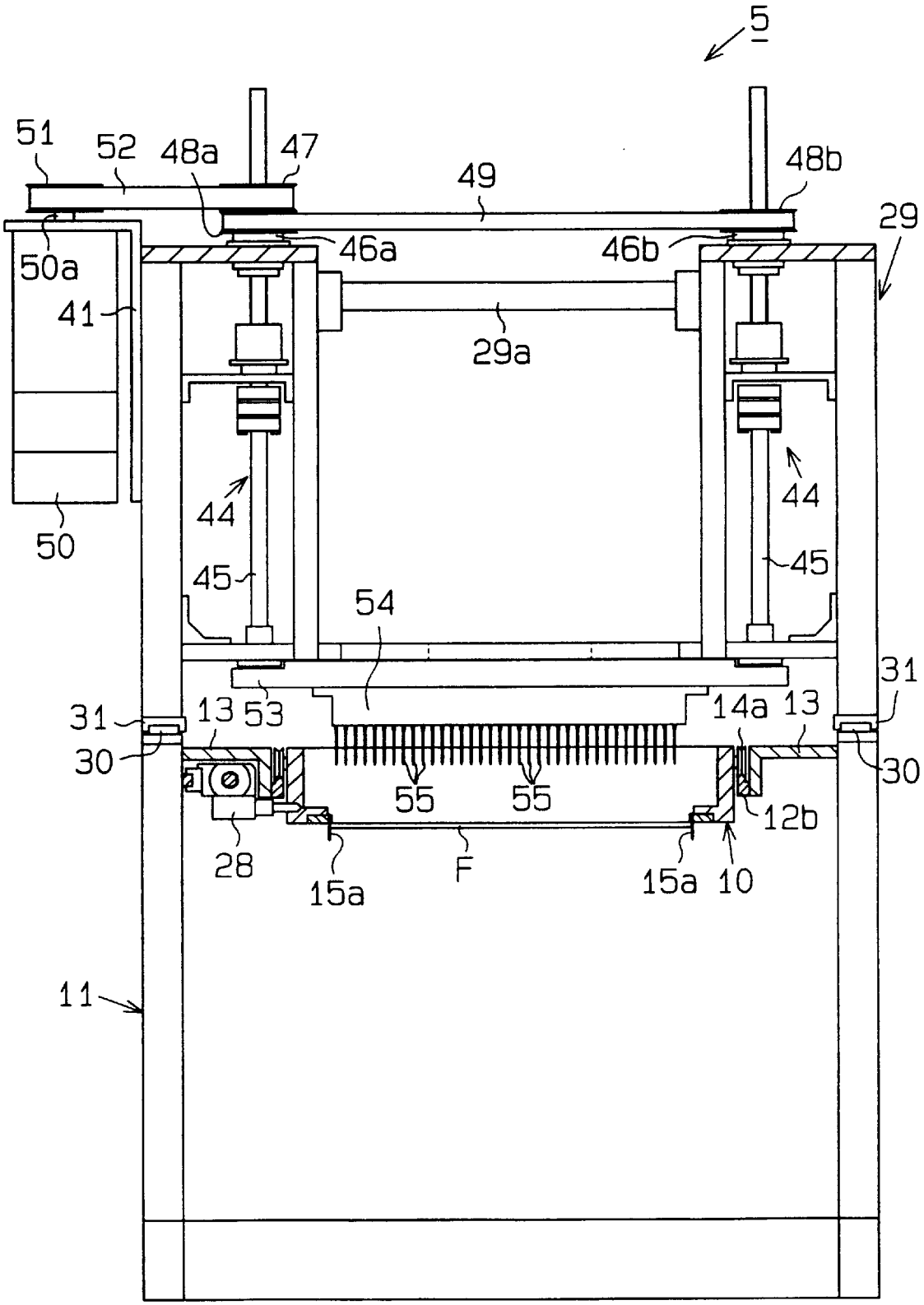
FIG. 9 is a diagrammatic front view illustrating an actuation mechanism for perforation needles.

As shown in FIGS. 5 and 9, the movable support frame 29 includes a pair of vertical lead screw mechanisms 44. The lead screw mechanisms 44 extend vertically and form a part of an elevating mechanism of the first actuation mechanism 5. Each lead screw mechanism 44 includes a shaft 45. A lead screw groove and a spline are formed on each shaft 45. A support bearing is directly fitted to each of a pair of nuts 46*a*, 46*b*, which engage the shafts 45, respectively. Rotating the nuts 46*a*, 46*b* causes the shafts 45 to move axially. The lead screw mechanisms 44 are commercially available (a product of THK Kabushiki Kaisha).

The lead screw nuts 46*a*, 46*b* of the lead screw mechanisms 44 are rotatably supported in the upper portion of the movable support frame 29. Pulleys 47, 48*a* are fixed to the nut 46*a*, which is located near the support bracket 41. The pulleys 47, 48*a* rotate integrally with the nut 46*a*. A pulley 48*b* is fixed to and rotates integrally with the other nut 46*b*. The pulley 48*a* is coupled to the pulley 48*b* by a belt 49. A servomotor 50 is fixed to the support bracket 41 adjacent to the servomotor 42. A drive pulley 51 is fixed to the drive shaft 50*a* of the servomotor 50. The drive pulley 51 is coupled to the pulley 47 by a belt 52. When the servomotor 50 is activated, the shafts 45 are either lifted or lowered in a synchronized manner.

As shown in FIG. 9, a coupler plate 53 is located between the lower ends of the shafts 45. A needle support 54 is secured to the coupler plate 53. Perforation needles 55 are fixed to the needle support 54 and are arranged in a row with a predetermined pitch. The pitch of the perforation needles 55 corresponds to the pitch of the insertion needles 40. As the shafts 45 are lifted and lowered, the coupler plate 53 is lifted and lowered, which lifts and lowers the perforation needles 55. A guide roller 29*a* is supported by the movable frame 29 above the perforation needles 55. The guide roller 29*a* leads connection yarns z to the insertion needles 40 such that the yarns z extend vertically. FIG. 9 is a diagrammatic front view of the first actuation mechanism 5 and does not show the tension applying mechanism 4, which is located behind the actuator 5, and the pressing mechanism 7, which is located below the actuator 5.

The servomotor 50 rotates the shafts 45 such that the perforation needles 55 are moved at an optimum rate when being inserted into the lamination F, when being removed from the lamination F, and when being moved without contacting the lamination F. Specifically, the shafts 45 are rotated slowly when the needles 55 are contacting the lamination F and quickly when the needles 55 are not contacting the lamination F.

As shown in FIGS. 1(*a*) and 3(*a*), the tension applying mechanism 4 is located upstream of the second actuation mechanism 6. The tension applying mechanism 4 includes a tension applying device 56 and a brake device 57. The tension applying device 56 is located in the path of the connection yarns z. The brake device 57 is closer to the feeding mechanism 3 than the tension applying device 56.

As shown in FIGS. 3(*a*) and 10, a support frame 58 is located on the body frame 11. The support frame 58 is perpendicular to the body frame 11 and is located closer to the feeding mechanism 3 than the movable support frame 29. The support frame 58 includes a pair of support walls 58*a*, which are spaced from each other by a distance greater than the width of each lamination F. Guide rollers 59*a* to 59*e* are supported by the support walls 58*a* at the same height as the guide roller 29*a*. The guide rollers 59*a* to 59*e* are parallel to one another. The guide rollers 59*a* and 59*b* are located in the vicinity of the feeding mechanism 3. A guide roller 59*f* is located between and below the guide rollers 59*a*, 59*b*.

Figure 10:
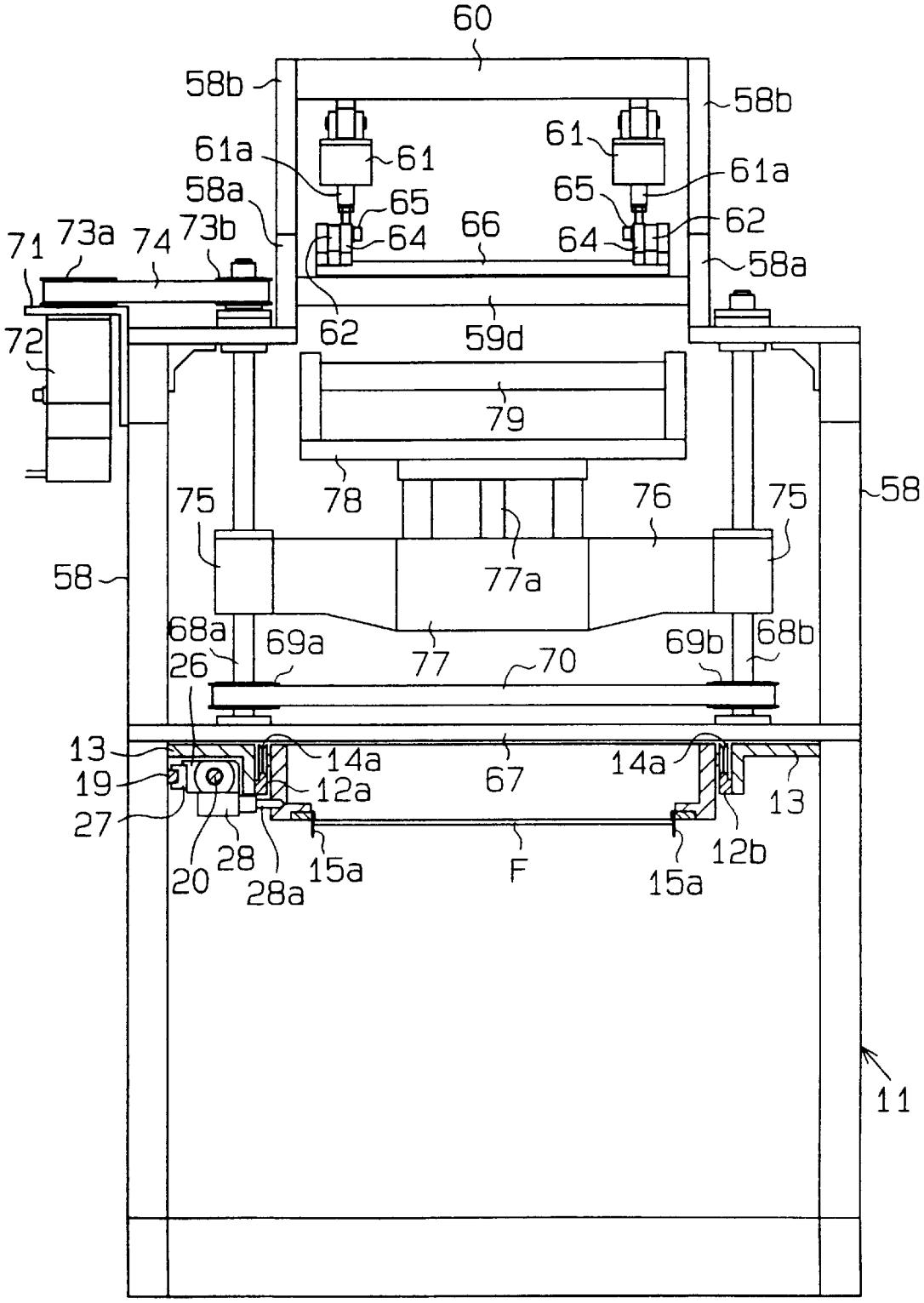
FIG. 10 is a diagrammatic front view illustrating a tension applying mechanism for connection yarns.

As shown in FIG. 10, a support 58*b* extends from each support wall 58*a* at a position close to the feeding mechanism 3. A support plate 60 is supported between the supports 58*b*. A pair of air cylinders 61 are pivotably supported by the support plate 60 through brackets. As shown in FIGS. 3 and 10, a support shaft 63 (see FIG. 3) is located below each air cylinder 61. Each support shaft 63 is supported by a bracket (not shown). The proximal end of a lever 62 is pivotally supported by each support shaft 63. The distal end of the lever 62 is pivotally coupled to the piston rod 61*a* of each air cylinder 61. A support member 64 is pivotally supported by each lever 62 through a shaft 65.

Brake bars 66 are fixed to the support members 64 to face the guide rollers 59*a*, 59*b*. A V-shaped groove is formed in each brake bar 66. An elastic member, such as a piece of rubber, is adhered to the V-shaped groove. The air cylinders 61, the levers 62, the support members 64 and the brake bars 66 form the brake device 57. The brake device 57 operates when the tension applying device 56 applies tension to the yarns z. Specifically, the brake device 57 operates with the guide rollers 59*a*, 59*b* to hold the yarns z.

As shown in FIG. 10, a support plate 67 extends horizontally and is located in the lower portion of the support frame 58. The support plate 67 is at a position corresponding to the guide rollers 59*c*, 59*d* and is perpendicular to the guide rail 19. A pair of moving mechanisms, which are lead screw mechanisms, are located between the upper portion of the support frame 58 and the support plate 67. Screw shafts 68*a*, 68*b* of the lead screw mechanisms extend vertically. Toothed pulleys 69*a*, 69*b* are fixed to the lower end of the shafts 68*a*, 68*b*, respectively. The pulleys 69*a*, 69*b* rotate integrally with the corresponding shafts 68*a*, 68*b*. The pulleys 69*a*, 69*b* are coupled to each other by a belt 70 such that the pulleys 69*a*, 69*b* rotate in a synchronized manner. A servomotor 72 is fixed to the upper portion of the support frame 58 by a bracket 71. A drive pulley 73*a* is fixed to the drive shaft of the servomotor 72. The drive pulley 73*a* is coupled to a driven pulley 73*b*, which is fixed to the screw shaft 68*a* by a belt 74.

A lead screw nut 75 is threaded to each of the screw shafts 68*a*, 68*b*. A support board 76 is supported between the lead screw nuts. The axis of a piston 77*a* of the air cylinder 77 lies in a vertical plane that perpendicularly bisects the guide rollers 59*c*, 59*d*. In this embodiment, the axis of the piston 77*a* is perpendicular to a plane that includes the axes of the guide rollers 59*c*, 59*d*. A support bracket 78 is fixed to the distal end of the piston rod 77*a*. A movable roller 79 is supported by the bracket 78 to extend parallel to the guide rollers 59*c*, 59*d*. That is, the movable roller 79 is reciprocated by two mechanisms, namely, by the lead screw mechanism actuated by the servomotor 72 and by the air cylinder 77 to change the length of the yarns z between the guide rollers 59*c*, 59*d*. The guide rollers 59*c*, 59*d*, the lead screw mechanism, the servomotor 72, the air cylinder 77 and the movable roller 79 form the tension applying device 56.

Figure 11:
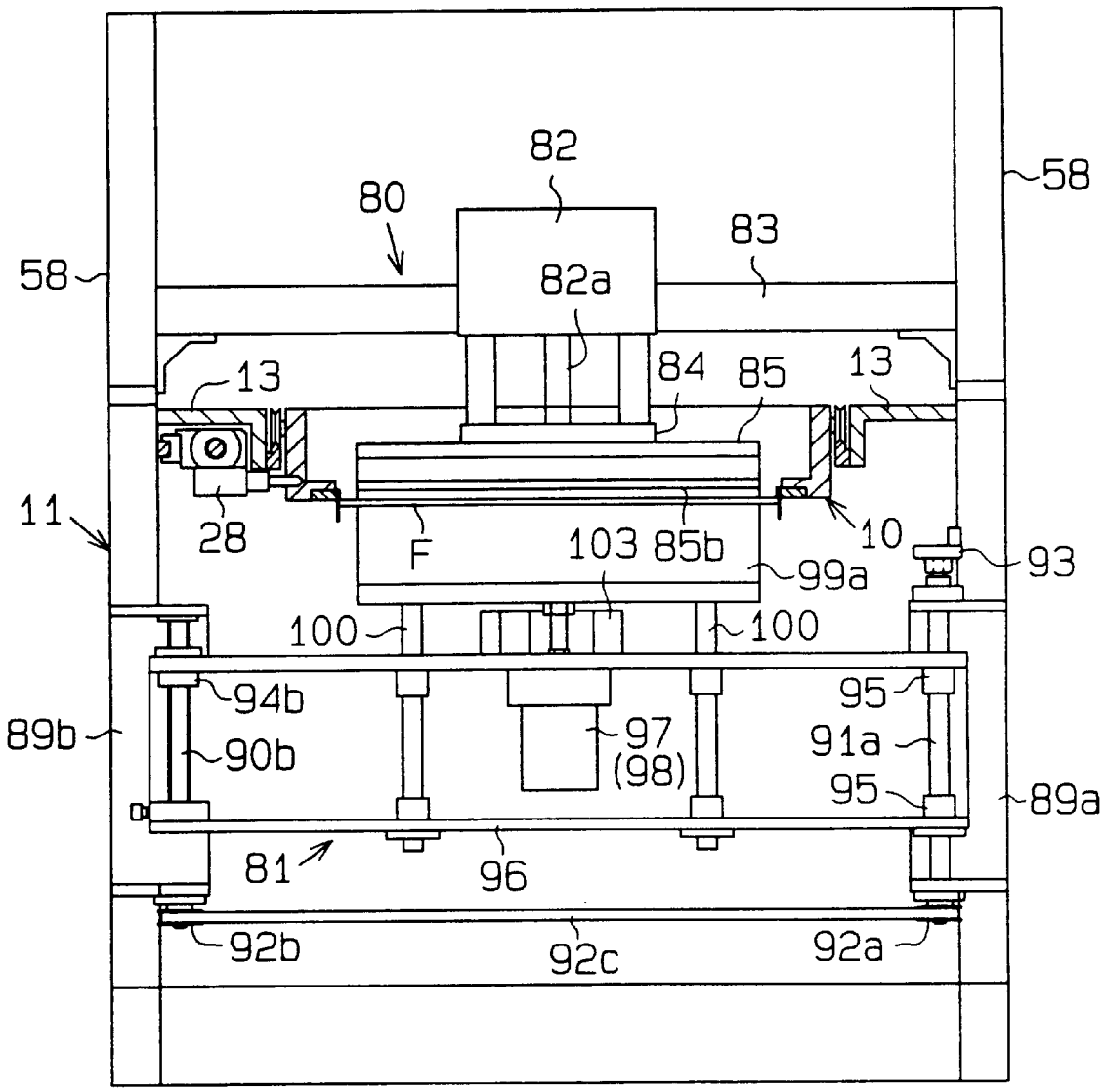
FIG. 11 is a diagrammatic front view illustrating a lamination pressing mechanism.

The pressing mechanism 7 for pressing the lamination F includes a first pressing mechanism 80 and a second pressing mechanism 81. The pressing mechanism 80 presses the lamination F from the side of insertion of the insertion needles 40, and the second pressing mechanism 81 presses the lamination F from the other side. The first pressing mechanism 80 includes a first air cylinder 82, which is fixed to a support plate 83 fixed to the support frame 58. The first air cylinder 82 is located below the first actuation mechanism 5. The air cylinder 82 has a piston rod 82*a*, which extends downward. A first pressing member, which is a press plate 85 in this embodiment, is fixed to the distal end of the piston rod 82*a*. The press plate 85 includes a support section 85*a* and a comb section 85*b*. The support section 85*a* has an L-shaped cross-section, and the comb section 85*b* is formed integrally with the support section 85*a*. The comb section 85*b* has teeth (not shown). Grooves are formed on the sides of each tooth to guide the insertion needle 40 and the perforation needle 55. The press plate 85 is pressed against the lamination F with the insertion needles 40 or the perforation needles 55 held by the comb section 85*b*. As shown in FIG. 11, the press plate 85 is slightly shorter (in the left-to-right direction of FIG. 11) than the corresponding inner dimension of the frame 15 such that the plate 85 is pressed against the lamination F without engaging the frame 15.

The press plate 85 is moved between an operational position and a standby position. When at the operational position, the press plate 85 is moved by the air cylinder 82 to engage the lamination F thereby pressing the lamination F in the advancing direction of the insertion needles 40. When at the standby position, the press plate 85 does not engage the lamination F.

An actuator, which is an air cylinder 87 in this embodiment, is located adjacent to the air cylinder 82 as shown in FIG. 8. The air cylinder 87 is supported horizontally and has a piston rod 87*a*. A stopper 88 is fixed to the piston rod 87*a*. The stopper 88 is located in the moving range of the piston rod 82*a* of the first air cylinder 82 to limit the retracting movement of the piston rod 82*a*. The air cylinder 87 moves the stopper 88 into and out of the moving range of the piston rod 82*a*. The stroke of the press plate 85 is adjusted among several discrete positions. In this embodiment, the press plate 85 is moved between two positions. Specifically, the press plate 85 is located at one of the positions when the stopper 88 is in the moving range of the piston rod 82*a*. The press plate 85 is located at the other position when the stopper 88 is out of the moving range of the piston rod 82*a*.

Figure 12:
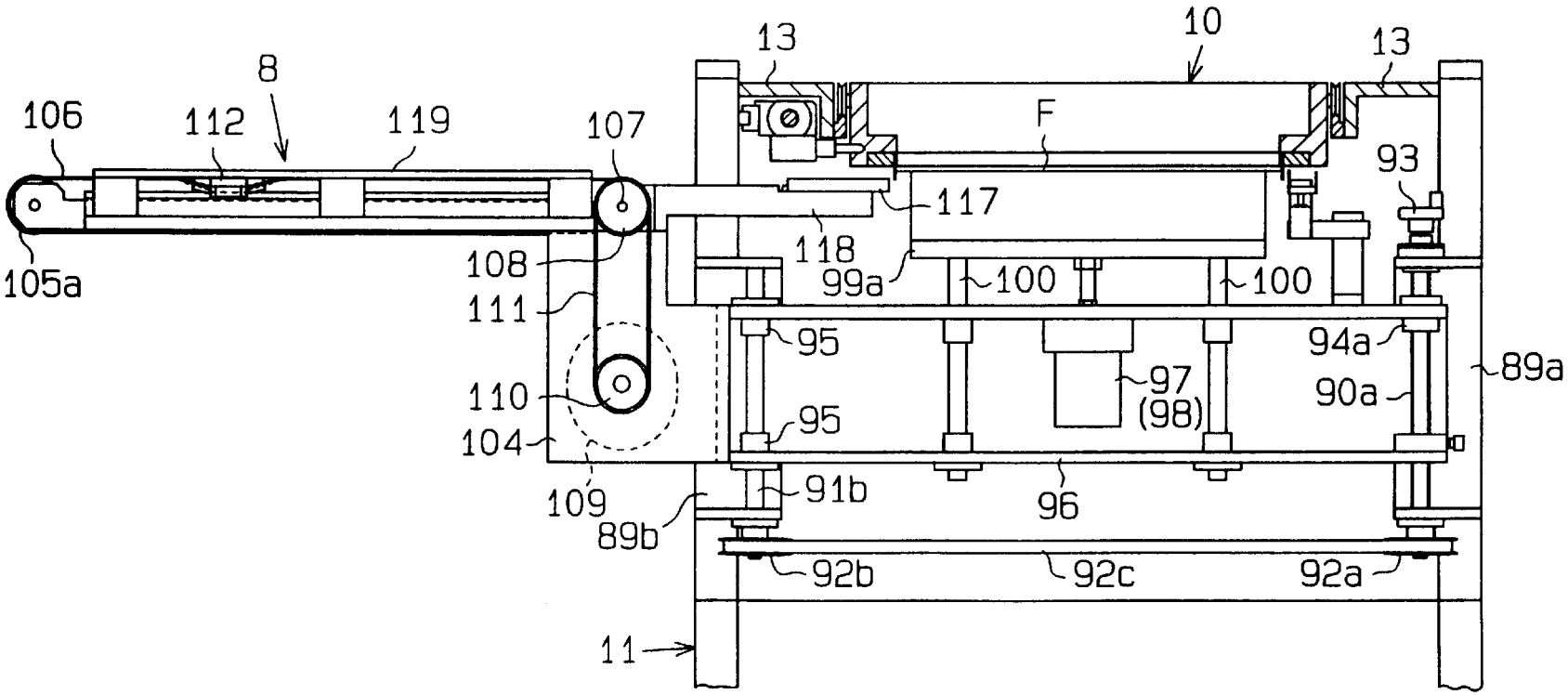
FIG. 12 is a diagrammatic front view illustrating a lamination pressing mechanism and a lock yarn inserting mechanism.

As shown in FIGS. 11 and 12, a pair of support brackets 89*a*, 89*b* are fixed to the sides of the body frame 11 below the support brackets 13. The support bracket 89*a* supports a screw shaft 90*a* of a lead screw mechanism and a guide rod 91*a*. The support bracket 89*b* supports a screw shaft 90*b* of a lead screw mechanism and a guide rod 91*b*. The screw shafts 90*a*, 90*b* and the guide rods 91*a*, 91*b* extend vertically. Pulleys 92*a*, 92*b* are fixed to the lower ends of the screw shafts 90*a*, 90*b*, respectively. The pulleys 92*a*, 92*b* rotate integrally with the screw shafts 90*a*, 90*b*, respectively. The pulleys 92*a*, 92*b* are coupled to each other by a belt 92*c*. An adjuster wheel 93 is fixed to the screw shaft 90*a* to rotate integrally with the shaft 90*a*. Rotating the wheel 93 causes the shafts 90*a*, 90*b* to rotate in a synchronized manner. FIGS. 11 and 12 are combined cross-sectional views in each of which left part and right part represent cross-sections at different levels to show the part for lifting and lowering the support frame 96. Also, the pressing mechanism 80 is not shown in FIG. 12.

Lead screw nuts 94*a*, 94*b* are threaded to the screw shafts 90*a*, 90*b*, respectively. Blocks 95 are slidably supported by the guide rods 91*a*, 91*b*. The support frame 96 is supported by the nuts 94*a*, 94*b* and the blocks 95. The support frame 96 is lifted and lowered below the inserting position of the connection yarns. Second air cylinders 97, 98 are secured to the support frame 96 and are spaced from one another in the moving direction of the carrier tables 10 as shown in FIG. 8. The air cylinders 97, 98 have piston rods 97*a*, 98*a* respectively. The piston rods 97*a*, 98*a* project upward. Second pressing members, which are press blocks 99*a*, 99*b* in this embodiment, are fixed to the distal end of the piston rods 97*a*, 98*b*, respectively.

The press blocks 99*a*, 99*b* each have an L-shaped cross-section and have the same length (in the left-to-right direction of FIG. 11) as the press plate 85. A pair of guide rods 100 are fixed to each of the press blocks 99*a*, 99*b*. The guide rods 100 extend through the support frame 96. The press blocks 99*a*, 99*b* face the comb section 85*b* of the press plate 85. The press blocks 99*a*, 99*b* are located close to each other such that there is a space in which the insertion needles 40 and the perforation needles 55 enter. The press blocks 99*a*, 99*b* are moved between an operational position and a standby position by the air cylinders 97, 98. At the operational position, the press blocks 99*a*, 99*b* engage the lamination F to press the lamination F in the retracting direction of the insertion needles 40. At the standby position, the press blocks 99*a*, 99*b* are separated from the lamination F.

As shown in FIG. 8, a support bracket 101 is attached to the support frame 96 to extend toward the feeding mechanism 3. An actuator, which is an air cylinder 102, is horizontally supported on the bracket 101. The air cylinder 102 has a piston rod 102*a*. A stopper 103 is fixed to the piston rod 102*a*. The stopper 103 is moved into the moving range of the piston rods 97*a*, 98*a* of the second air cylinders 97, 98 and engage the press blocks 99*a*, 99*b* to limit the retracting movement of the piston rods 97*a*, 98*a*. A step is formed on the upper side of the stopper 103. The step forms first and second engagement portions 103*a*, 103*b*. The first engagement portion 103*a* is lower than the second engagement portion 103*b*. The first engagement portion 103*a* engages with the first press block 99*a*, which is located further from the connection yarn feeding mechanism 3 than the second press block 99*b*. The second engagement portion 103*b* engages the second press block 99*b*.

The stopper 103 is moved in and away from the moving range of the piston rods 97*a*, 98*a* by the air cylinder 102. The press blocks 99*a*, 99*b* have discretely differing strokes. In this embodiment, the piston rods 97*a* 98*a* are moved between two positions, that is, between a position at which the stopper 103 is in the moving range of the piston rods 97*a*, 98*a* and a position at which the stopper 103 is outside the moving range.

Figure 13:
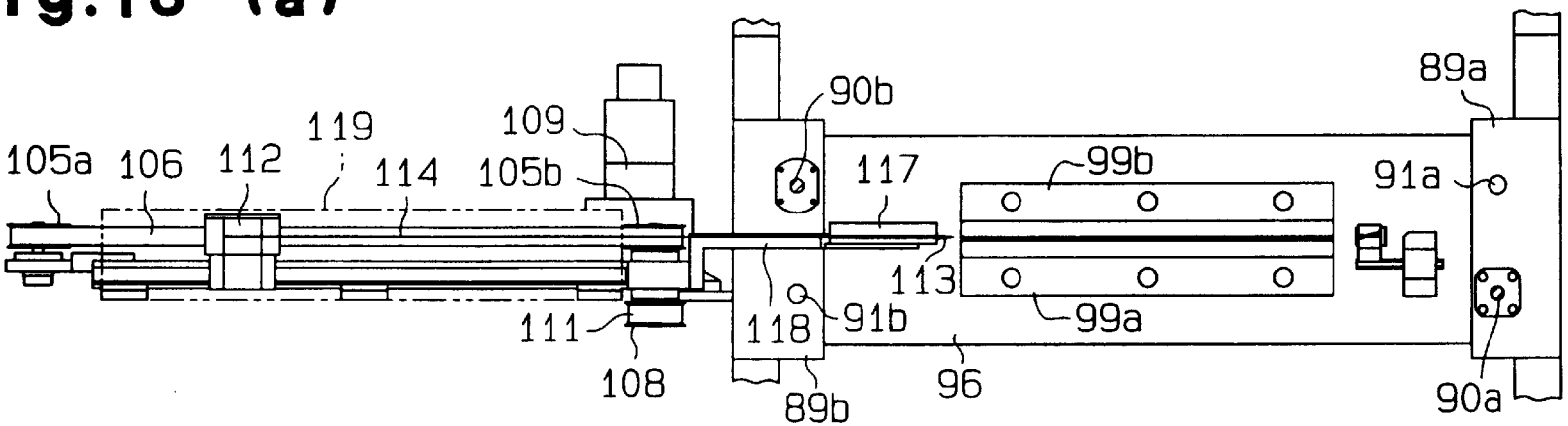
FIG. 13(*a*) is a plan view showing the lock yarn inserting mechanism of FIG. 12.
Figure 13:
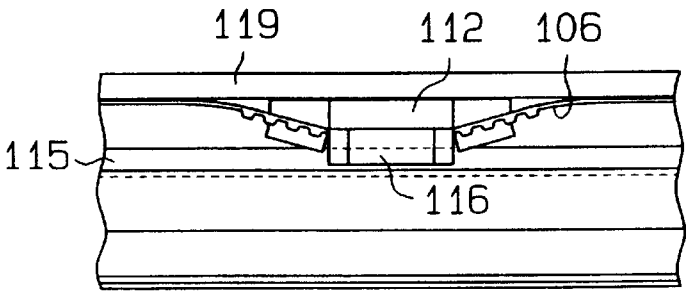
Figure 13:
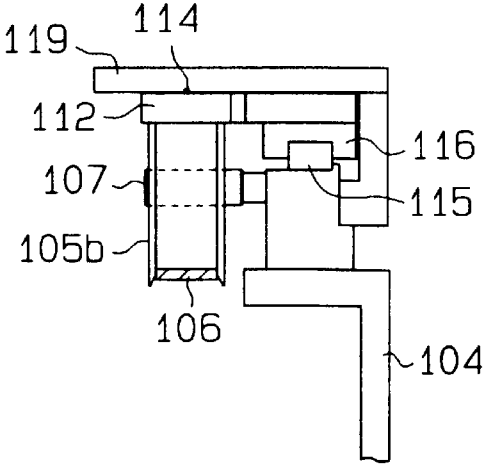

As shown in FIGS. 2(*a*) and 4, the lock yarn inserting mechanism 8 protrudes laterally from the body frame 11. As shown in FIG. 12, a support frame 104 of the inserting mechanism 8 is supported by the support frame 96 of the press blocks 99*a*, 99*b*. As shown in FIGS. 12, 13, the support frame 104 extends horizontally at a position that is slightly lower than the carrier table 10 and has a pair of pulleys 105*a*, 105*b*. The axes of the pulleys 105*a*, 105*b* are perpendicular to the row of the insertion needles 40 shown in FIG. 6. An endless belt 106 is engaged with the pulleys 105*a*, 105*b*. Part of the path of the belt 106 is parallel to the row of the insertion needles 40.

The first pulley 105*a* is located away from the body frame 11, and the second pulley 105*b* is located near the body frame 11. The second pulley 105*b* is fixed to a rotary shaft 107 (see FIG. 12) to rotate integrally with the shaft 107. Another pulley 108 is fixed to the other end of the shaft 107 to rotate integrally with the shaft 107. A servomotor 109 is supported by the support frame 104 below the pulley 105*b*. A drive pulley 110 is fixed to the drive shaft of the servomotor 109. The drive pulley 110 is coupled to the pulley 108 by a belt 111. As the servomotor 109 rotates in forward and reverse directions, the belt 106 move accordingly.

The belt 106 is parallel to the row of the insertion needles 40. The upper portion of the belt 106 is at the same level as the insertion path of the lock yarn P. A fixing member 112 is fixed to the outer surface of the belt 106. The fixing member 112 fixes a rod 114 to the belt 106. As shown in FIG. 13(*a*), a support member, which is the proximal end of the rod 114, is fixed to the fixing member 112. A lock yarn insertion needle 113 is fixed to the distal end of the rod 114. The rod 114 is made of a carbon fiber reinforced resin.

As shown in FIGS. 12, 13(*b*), a guide rail 115 is fixed to the support frame 104. The guide rail 115 extends horizontally between the upper and lower horizontal portions of the belt 106. A guide 116 is fixed to the fixing member 112. The guide 116 slides along the guide rail 115 to prevent the fixing member 112 from being displaced in the lateral direction of the belt 106. A rod guide 117 is fixed to the support frame 104 by a bracket 118. The rod guide 117 is located in the vicinity of the row of the insertion needles 40 when the needles 40 are located at the operational position. A guide groove is formed in the upper surface of the rod guide 117 to prevent lateral displacement of the rod 114. A cover 119 is located above the horizontal portion of the belt 106 to prevent the rod 114 from moving upward.

The servomotors 23, 42, 50, 72, 109 are electrically connected to and controlled by signals from a controller 120, which is shown only in FIG. 1. Each of the air cylinders 28, 33, 82, 87, 97, 98, 102 is connected to an electromagnetic valve. Each valve supplies compressed air to and draws air from the corresponding air cylinder and is electrically connected to the controller 120. The air cylinders 28, 33, 82, 87, 97, 98, 102 are controlled by signals from the controller 120 and are actuated in a predetermined order.

Figure 14:
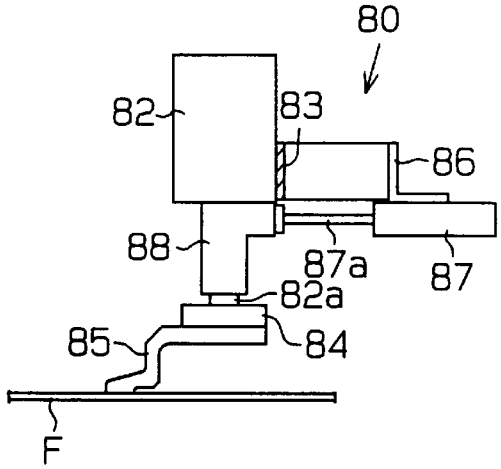
FIGS. 14(*a*), 14(*b*), 14(*c*) are side views for showing the operation of a press plate.
Figure 14:
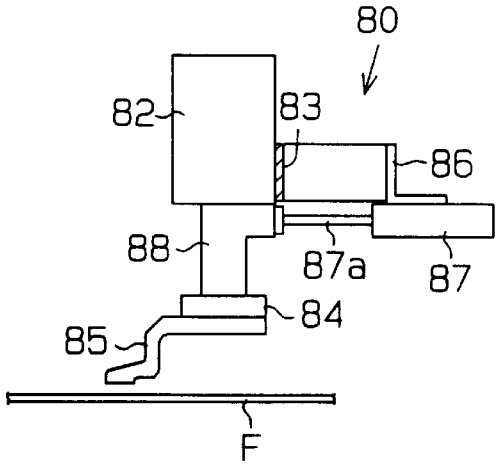
Figure 14:
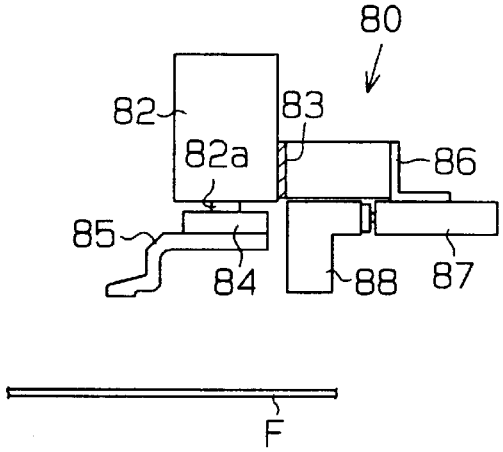
Figure 15:
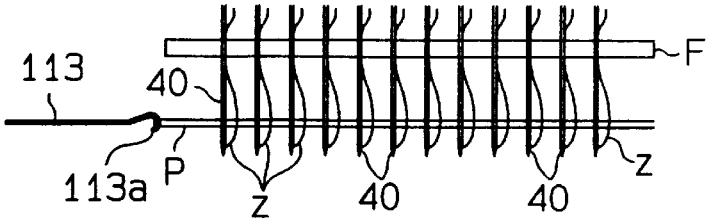
FIG. 15 is a diagrammatic view showing the insertion of a lock yarn.
Figure 16:
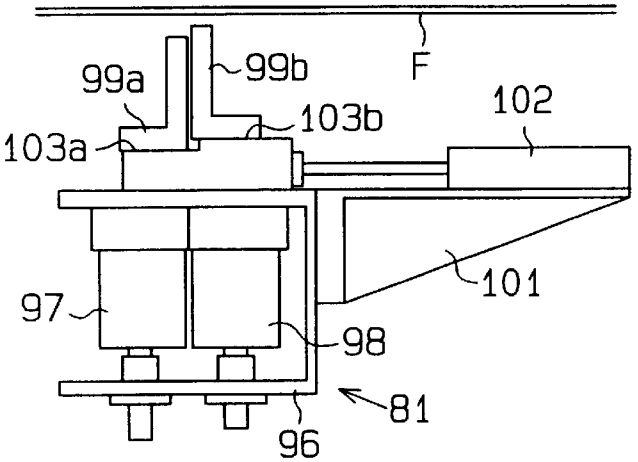
FIGS. 16(*a*), 16(*b*), 16(*c*) are side views showing the operation of the press block.
Figure 16:
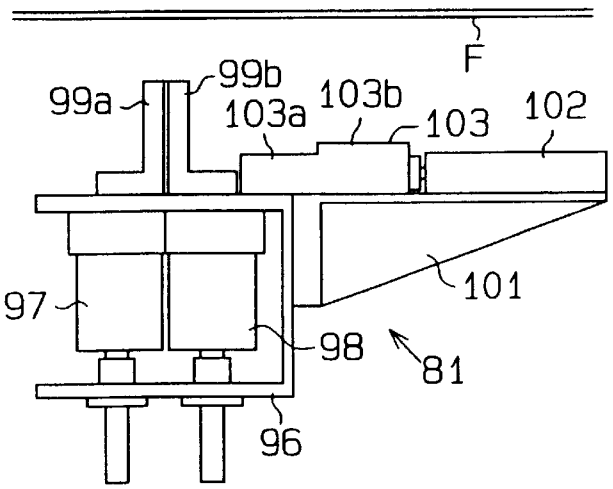
Figure 16:
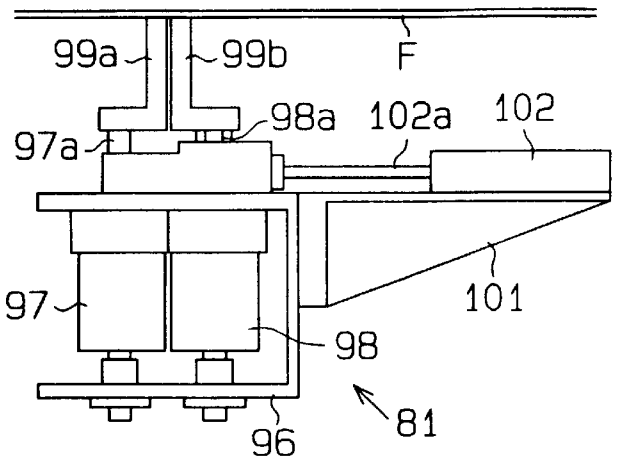
Figure 17:
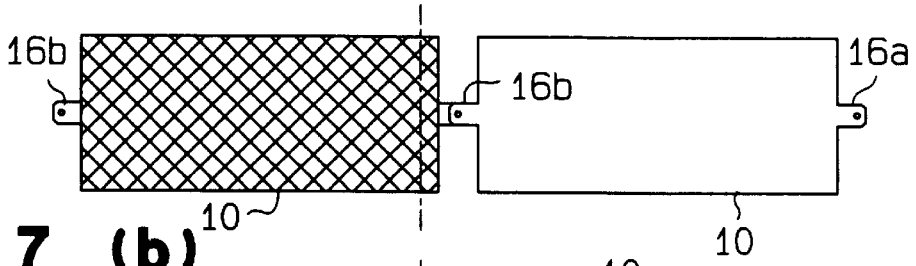
FIGS. 17(*a*) and 17(*b*) are plan views for showing the operation of the carrier tables.
Figure 17:
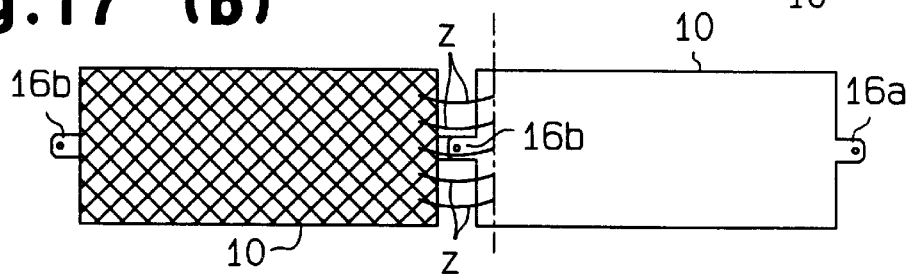

The operation of the above described connection yarn inserting apparatus 1 will now be described. Before starting the insertion of the connection yarns z, the operational members of the apparatus 1 are located at the standby position or the initial position. For example, as shown in FIGS. 14(*c*) and 16(*c*), the stoppers 88, 103 are at the standby positions, at which they do not engage the press blocks 99*a*, 99*b*. The press plate 85 and the press blocks 99*a*, 99*b* are located at the standby positions, at which the press plate 85 and the press blocks 99*a*, 99*b* do not engage the carrier table 10.

The preparation of the connection yarn insertion is done as follows. Fiber layers are laminated by a conventional method to form a lamination F, which has fibers arranged in at least two directions, or axes. The lamination F is fixed on the frame 15. The frame 15 is then secured to one of the carrier tables 10. The table 10 is placed on the support rails 12*a*, 12*b* at a position upstream from the position of the second actuation mechanism 6 for inserting connection yarn needles. Next, the carrier table 10 is manually moved to a position where the hole 14*b* (FIG. 7) faces the piston rod 28*a* of the air cylinder 28. The air cylinder 28 is fixed to the lead screw nut 26, which is at the standby position. In this state, the air cylinder 28 is actuated to cause the piston rod 28*a* to engage the hole 14*b*, which permits the carrier table 10 to move integrally with the lead screw nut 26 on the guide rail 19.

Thereafter, the servomotor 23, which is shown in FIG. 1(*a*), rotates the screw shaft 20 in the forward direction. This moves the carrier table 10 with the lead screw 26 to a position where the lamination F faces the perforation needles 55. The air cylinders 82, 97, 98 are then actuated to move the press plate 85 and the press blocks 99*a*, 99*b* to the operational positions as shown in FIGS. 14(*a*) and 16(*a*). The air cylinder 87, 102 are actuated in this state to move the stoppers 88, 103 to a position shown in FIGS. 14(*a*) and 16(*a*) for engaging the press blocks 99*a*, 99*b*.

The air cylinders 82, 97, 98 are actuated to move the press plate 85 and the press blocks 99*a*, 99*b* to the standby positions shown in FIGS. 14(*b*) and 16(*b*), where the press blocks 99*a*, 99*b* engage the stoppers 88, 103. The stoppers 88, 103 are retained at the operational position until the insertion of the connection yarns z to the lamination F is completed. The strokes of the press plate 85 and the press blocks 99*a*, 99*b* are shorter when the stoppers 88, 103 are at the operational positions than when the stoppers 88, 103 are at the standby positions.

The connection yarns z are fed from the first feeding mechanism 3. The yarns z are engaged with the guide rollers 59*a*, 59*f*, 59*b*, 59*c*, movable roller 79, the guide rollers 59*d*, 59*e*, 29*a* and inserted into the eyes (not shown) of the insertion needles 40. The end of each yarn z is fixed to the frame 15. The preparation of the connection yarns z is thus completed.

Prior to the operation of the insertion needles 40, connection yarns z, each of which has a predetermined length, are bent and reserved between the movable roller 79 and the guide rollers 59*c*, 59*d*. This applies a weak tension to the yarns z such that the yarns z do not become loose. The tension is set weak enough not to disturb the handling of the yarns z. When reserving the connection yarns z, the brake bars 66 are first located at a non-braking position and the movable roller 79 is at the same height as the guide rollers 59*c*, 59*d*. Then, the servomotor 72 rotates in the forward direction to lower the movable roller 79 through the lead screw mechanism.

When the movable roller 79 is lowered to a position for reserving the predetermined length of the connection yarns z, the air cylinder 61 is actuated to move the brake bars 66 to the braking position. The yarns Z are held by the brake bars 66 and the guide rollers 59*a*, 59*b*. Accordingly, the yarns z of the predetermined length are reserved between the movable roller 79 and the guide rollers 59*c*, 59*d*.

The insertion of the connection yarns z is started in this state. The air cylinders 82, 97, 98 are actuated to move the press plate 85 and the press blocks 99*a*, 99*b* to the operational positions. The press plate 85 and the press blocks 99*a*,

99*b* compresses the lamination F at a position corresponding to the row of the perforation needles 55. The servomotor 50 rotates in the forward direction to actuate the lead screw mechanism, which moves the perforation needles 55 toward the lamination F. Accordingly, the needles 55 are moved to the operational position and penetrate the lamination F. Thereafter, the servomotor 50 rotates in the reverse direction to move the needles 55 to the standby position.

The perforation needles 55 are moved quickly when separated from the lamination F and are moved slowly when engaging the lamination F. The perforation needles 55 are guided by the comb section 85*b* and penetrate the lamination F at a right angle. Since the fibers forming the lamination F are compressed by the press plate 85 and the press blocks 99*a*, 99*b*, holes formed remain on the lamination F after the perforation needles 55 are removed. Also, since the lamination F is pressed by the press blocks 99*a*, 99*b* at the side where the distal end of the perforation needles 55 protrude, the arrangement of the fibers of the lamination F remain in place during the advancement of the perforation needles 55.

The air cylinder 33 is actuated to move the movable frame 29 near the first feeding mechanism 3 such that the insertion needles 40 face the holes formed by the perforation needles 55.

The air cylinder 97 is actuated to move the press block 99*a* to the standby position. Thereafter, the servomotor 42 shown in FIG. 4 rotates in the forward direction to move the insertion needles 40 toward the lamination F through the corresponding lead screw mechanism. The insertion needles 40 are moved to the operational position. That is, the insertion needles 40 penetrate the lamination F until the eye of each needle 40 is located below the lamination F. After the needles 40 are moved to the end of the movement range, the servomotor 42 rotates in the reverse direction to retract the insertion needles 40 by a predetermined amount. As a result, a loop is formed in each yarn z, which runs from the lamination F to the eye of the associated needle 40. The loops receive the lock yarn needle 113. The needles 40 are moved quickly when separated from the lamination F and are moved slowly when engaging the lamination F.

When the servomotor 42 is advancing the insertion needles 40, the servomotor 72 rotates in the reverse direction at a rate corresponding the speed of the insertion needles 40. That is, the servomotor 72 lifts the movable roller 79 to advance the sections of the yarns z reserved between the movable roller 79 and the guide rollers 59*c*, 59*d*.

When the insertion needles 40 are inserted into the lamination F, the press block 99*a* is moved to the standby position. This decreases the pressing force against the lamination F. However, since the insertion needles 40 are inserted into the holes formed by the perforation needles 55, the resistance against the insertion needles 40 during insertion is small. This allows the fibers of the lamination F to remain in position.

The servomotor 109 shown in FIG. 12 rotates in the forward direction to advance the lock yarn needle 113 together with the fixing member 112. The distal end of the needle 113 consecutively passes through the loops of the yarns z held by the insertion needles 40. The needle 113 stops when it reaches the edge of the lamination F. The lock yarn P is then hooked to a hook 113*a* at the distal end of the needle 113. The latch (not shown) of the needle 113 is then closed. The needle 113 is moved back through the loops of the yarns z such that the needle 113 does not hook the loops. As a result, two lines of the lock yarn P extend through the loops of the connection yarns z.

Thereafter, the servomotor 42 rotates in the reverse direction to remove the insertion needles 40 from the lamination F to the standby position. The needles 40 are moved slowly when engaging the lamination F and are moved quickly when separated from the lamination F. The air cylinder 97 then moves the press block 99*a* to the operational position once more. In this state, the tension applying mechanism 4 pulls back the connection yarns z inserted into the lamination F and tightens them with the lock yarn P. The lock yarn P prevents the connection yarns z from being removed from the lamination F.

After the insertion needles 40 are removed from the lamination F, the fiber layers of the lamination F are tightly held together with the connection yarns z. Specifically, the servomotor 72 rotates in the forward direction to lower the movable roller 79 to a predetermined position. Then, air that is compressed to a predetermined pressure is sent to the air cylinder 77. The air cylinder 77 tightens the fiber layers accordingly. In other words, the fiber layers are tightly held together by the force of the compressed air supplied to the air cylinder 77.

The air cylinder 33 then returns the movable support frame 29 together with the perforation needles 55 and the insertion needles 40 to the initial position. The air cylinders 82, 97, 98 are actuated to move the press plate 85 and the press blocks 99*a*, 99*b* to the standby positions. This completes a single inserting cycle of the connection yarns z.

The motor 23 then rotates in the forward direction to advance the carrier table 10 together with the lead screw nut 26 by a distance equal to the inserting pitch of the yarns z. The perforation needles 55 are opposed to the lamination F at the next connection yarn inserting position. The steps of the connection yarns inserting cycle, which include the reservation of the yarns z, are repeated. During the final insertion of the connection yarns z into a lamination F, the air cylinders 87, 102 are actuated to move the stoppers 88, 103 to the standby position after the lamination F is tightened with the yarns z and before the air cylinders 82, 97, 98 are actuated. Thereafter, the air cylinders 82, 97, 98 are actuated to move the press plate 85 and the press blocks 99*a*, 99*b* to the standby position shown in FIGS. 14(*c*) and 16(*c*), where the press plate 85 and the press blocks 99*a*, 99*b* do not engage the stoppers 88, 103.

Before insertion of the connection yarn z to the lamination F on a carrier table 10 is completed, a subsequent carrier table 10, on which an unfinished lamination F is placed, is connected to the rear of the preceding table 10. Therefore, when the insertion of the connection yarns z in the lamination F on the preceding carrier table 10 is completed, as illustrated by cross-hatching in FIG. 17(*a*), the next table 10 having another lamination F is coupled to the preceding carrier table 10.

In this state, the air cylinder 28 is actuated to separate the piston rod 28*a* from the hole 14*b*. Then, the servomotor 23 rotates in the reverse direction to move the lead screw nut 26 to a position where the hole 14*b* of the following table 10 faces the piston rod 28*a*. The air cylinder 28 is actuated to cause the piston rod 28*a* to engage the hole 14*b*, which permits the table 10 to move integrally with the lead screw nut 26. The servomotor 23 then rotates in the forward direction to advance the following table 10. Accordingly, the table 10 advances while pushing the preceding table 10 to a position shown in FIG. 17(*b*), or to a position facing the connection yarn insertion position shown by broken line in FIGS. 17(*a*) and 17(*b*). The connection yarn insertion is repeated on the new lamination F in the above described manner.

The connection yarns z, which extend from the first feeding mechanism 3 to the insertion needles 40 via the guide rollers 59*a* to 59*f*, are still connected to the finished lamination F. The connection yarns z are then positioned at the initial insertion position for the next lamination F on the following table 10. Therefore, the connection yarn insertion to the lamination F on the following table 10 is started without the preparation. Then, the insertion cycle of the connection yarn z is repeated. When the coupler 16*a* of the finished table 10 is moved downstream the second actuation mechanism 6 as shown in FIG. 2(*a*), the connection yarns z connecting the finished lamination F to the unfinished lamination F are cut. When the tables 10 are disconnected, the table 10 of the finished lamination F is removed from the connection yarn inserting apparatus 1.

The first embodiment of the FIGS. 1 to 7(*b*) has the following advantages.

The first and second pressing members (the press plate 85 and the press blocks 99*a*, 99*b*) are actuated by the air cylinders 82, 97, 98. The strokes of the first and second pressing members are controlled by the actuators (the air cylinders 87, 102). Therefore, when the perforation needles 55 and the insertion needles 40 are inserted into the lamination F and when the needles 55, 40 are removed from the lamination F, the yarn arrangement of the lamination F is not disturbed. Also, the fiber layers of the lamination F are easily tightened by the connection yarns z.

When the connection yarn insertion for the lamination F on a carrier table 10 is completed, a next carrier table 10, which carries an unfinished lamination F, is moved to the connection yarn insertion position. At this time, the first and second pressing members are moved to the positions shown in FIGS. 14(*c*) and 16(*c*). While the insertion of the connection yarns z is performed, the pressing members are moved between the position shown in FIGS. 14(*a*) and 16(*a*) and the positions shown in FIGS. 14(*b*) and 16(*b*). Therefore, the distance between the lamination F and the pressing members when the stoppers 88, 103 do not engage the pressing members as shown in FIGS. 14(*c*) and 16(*c*) can be relatively large while the stroke of the pressing members between the state of FIGS. 14(*a*) and 16(*a*) and the state of FIGS. 14(b) and 16(b) relatively small. This reduces the operational time required for inserting connection yarns into laminations F. The productivity of the three-dimensional fabric stitching process is improved, accordingly.

The pressing members are actuated by the air cylinders 82, 97, 98. Compared to an apparatus where the pressing members are actuated by motors and lead screw mechanisms, using the air cylinders 82, 97, 98 simplifies the structure. Also, the force pressing the lamination F can be easily adjusted by controlling the pressure of air supplied to the air cylinders 82, 97, 98. Unlike lead screw mechanisms, air cylinders act as cushions, which prevent the lamination F from receiving an excessive force.

The actuators for actuating the stoppers 88, 103 are the air cylinders 87, 102. Compared to a lead screw 10 mechanisms, the air cylinders 87, 102 simplify the structure.

The second pressing mechanism 81, together with the support frame 96, is arranged perpendicular to the lamination F at the inserting position of the connection yarns z. Thus, the position of the second pressing members (the press blocks 99*a*, 99*b*) can be adjusted in accordance with the thickness of the three-dimensional fabric, or the thickness of the lamination F. In other words, the distance between the standby position and the lamination F can be optimized in accordance with the thickness of the lamination F.

The support frame 96 is supported, lifted, and lowered by the lead screw nuts 94*a*, 94*b* of the corresponding lead screw mechanisms. The screw shaft 90*a* of the lead screw mechanism is rotated by the manually operated wheel 93. The structure of the elevation mechanism of the support frame 96 is therefore simple.

The movable roller 79 forms part of the device for tensioning the connection yarns z. The roller 79 is located between the fixed rollers (the guide rollers 59*c*, 59*d*). The movable roller 79 is moved by the air cylinder 77 and the lead screw mechanism actuated by the servomotor 72 to change the length of the yarn z between the guide rollers 59*c*, 59*d*. That is, the movable roller 79 is moved by two different actuating systems. When reserving the connection yarns z and when the insertion needles 40 are moved by a great amount for inserting the yarns z into the lamination F, the movable roller 79 is quickly moved to a desired position by the servomotor 72.

If the movable roller 79 is actuated solely by the lead screw mechanism driven by the servomotor 72, the tension of the connection yarns z could not be controlled various ranges corresponding to the inserting conditions. However, in this embodiment, the tension of the yarns z is controlled by adjusting the pressure of compressed air supplied to the air cylinder 77. As a result, the tension of the yarn z is optimized depending on the condition of current three-dimensional fabric, which reduces the time required for inserting the connection yarns. Accordingly, productivity is improved.

The apparatus of the embodiment shown in FIGS. 1 to 7(*b*) includes the conveying mechanism 2. The conveying mechanism 2 moves the carrier tables 10 by the predetermined pitch. Specifically, the conveying mechanism 2 causes a table 10 having an unfinished lamination F to follow a table 10 having a finished lamination F such that the tables 10 consecutively pass the connection yarn inserting position. Therefore, unlike prior art apparatuses, the apparatus of FIGS. 1 to 7(*b*) consecutively performs connection yarn insertion on multiple laminations without repeating the troublesome preparation. Specifically, the operator only needs to remove a carrier table 10 having a finished lamination F and feed a carrier table 10 having an unfinished lamination F. As a result, the time required for inserting connection yarns is reduced in the total manufacturing time of three-dimensional fabric, which improves productivity.

The adjacent carrier tables 10 are coupled to each other by the couplers 16*a*, 16*b* and are moved integrally. The actuator (the air cylinder 28) includes the coupling member (the piston rod 28*a*), which engages the engagement portion (hole 14*b*) of the carrier table 10. The air cylinder 28 is reciprocated by the lead screw nut 26 of the corresponding lead screw mechanism within a range. The range is greater than the corresponding range of the carrier table 10. The mechanism for moving the carrier table 10 by the predetermined pitch is therefore simple. Also, the pitch can be accurately adjusted.

The carrier tables 10 are held horizontally and are moved to a position below the first actuation mechanism 5 for the perforation needles 55 and the second actuation mechanism 6 for the insertion needles 40. The lamination conveying mechanism 2 moves the laminations F through the insertion position of the connection yarns z by using the carrier table 10. The lamination conveying mechanism 2 therefore has a simple structure.

The lock yarn needle 113 inserts the lock yarn P through the loops of the connection yarns z, which are arranged along the row of the insertion needles 40. The endless belt 106 is engaged with the pulleys 105*a*, 105*b* and actuated by a motor (the servomotor 109). The lock yarn needle 113 is fixed to the belt 106 by the support member and is linearly moved as the belt 106 is reciprocated. Compared to a case where the lock yarn needle 113 is moved by a lead screw mechanism actuated by a servomotor, the needle 113 moves more. Thus, the time for moving the lock yarn needle 113 in the insertion of connection yarns is reduced, which improves productivity.

The perforation needles 55 are reciprocated by the lead screw mechanism actuated by the servomotor 50. The perforation needles 55 are moved quickly when the needles 55 are not contacting, or are not engaging, the lamination F. The needles 55 are moved slowly when contacting, or engaging, the lamination F. This reduces the manufacturing time while maintaining the quality of the finished three-dimensional fabric. Accordingly, productivity is improved.

The insertion needles 40 are reciprocated by the lead screw mechanism actuated by the servomotor 42. The needles 40 are moved quickly when the needles 40 are not contacting, or are not engaging, the lamination F. The needles 40 are moved slowly when contacting, or engaging, the lamination F. In other words, the speed of the needles 40 is varied in each stroke. This reduces the manufacturing time while maintaining the quality of the finished three-dimensional fabric. Accordingly, the productivity is improved.

The support frame 104 of the lock yarn inserting mechanism 8 is fixed to the support frame 96 located on the second pressing mechanism 81. The support frames 96, 104 are lifted and lowered integrally. When the position of the second pressing mechanism 81 is adjusted in accordance with the thickness of the lamination F, the position of the lock yarn inserting mechanism 8, or the position of the lock yarn needle 113 relative to the lamination F, is automatically optimized.

A second embodiment of the present invention will now be described with reference to FIGS. 18(*a*) to 19. Unlike the embodiment of FIGS. 1 to 17(*b*), the support frame 96, which forms a part of the second pressing mechanism 81, is not manually operated but is automatically lifted or lowered. Other structures are the same as the apparatus of FIGS. 1 to 17(*b*). As shown in FIG. 19, a servomotor 122 is located above the screw shaft 90*a*. Specifically, a bracket 121 is fixed to the support bracket 89*a* and the servomotor 122 is mounted on the bracket 121. The shaft 90*a* is coupled to the drive shaft of the servomotor 122 by a coupler to rotate integrally with the drive shaft. The servomotor 122 is electrically connected to the controller 120 and is actuated by commands from the controller 120.

The controller 120 adjusts the vertical position of the support frame 96 in accordance with the thickness of the lamination F prior to insertion of the connection yarn z. Specifically, the controller 120 controls the servomotor 122 based on the thickness of the lamination F, which is entered through an input device (not shown). The relationship between the thickness of the lamination F and the proper position of the support frame 96 is stored in a database stored in a memory. The controller 120 computes the proper position of the support frame 96 in accordance with the inputted lamination thickness referring to the database and controls the servomotor 122, accordingly.

During insertion of the connection yarns z, the controller 120 controls the servomotor 122 to lift or lower the support frame 96 to lift or lower the lock yarn inserting mechanism 8. In one insertion cycle of the connection yarns z, the insertion needles 40 are moved to the operational positions such that a loop of the connection yarn z is formed at the distal end of each insertion needle 40. Until the two lines of the lock yarn P are inserted in the loops as illustrated in FIG. 18(*a*), the lock yarn inserting mechanism 8 is retained at the initial position. The needles 40 are then retracted and the yarn z is retracted accordingly. At this time, the support frame 96 is lifted to lift the lock yarn needle 113 to a position of FIG. 18(*b*), where the lock yarn needle 113 is at the same level as the bottom side of the lamination F.

When the support frame 96 is lifted, the pressure of the compressed air supplied to the air cylinders 97, 98 is lowered to prevent the press blocks 99*a*, 99*b* from applying excessive force to the lamination F. When the support frame 96 is lifted to a predetermined height, a predetermined air pressure is applied to the air cylinders 97, 98 again. After tightening of the lamination F with the connection yarns z is completed, the servomotor 122 is actuated to lower the support frame 96, which moves the lock yarn insertion needle 113 to the initial position.

Figure 18:
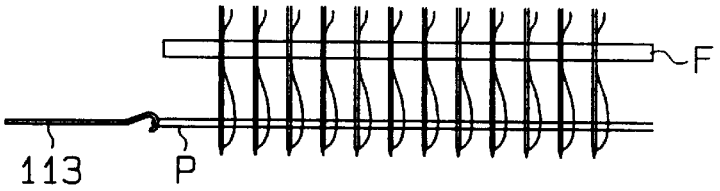
FIGS. 18(*a*), 18(*b*) are diagrammatic views for showing the operation of the lock yarn insertion needle according to a second embodiment.
Figure 18:
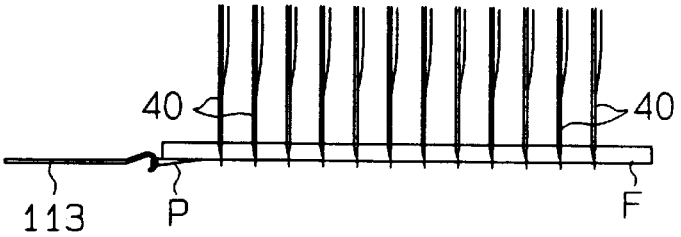
Figure 18:
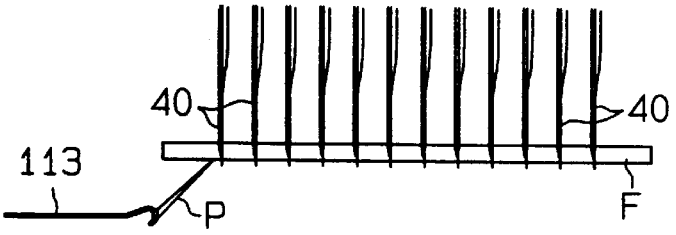
Figure 19:
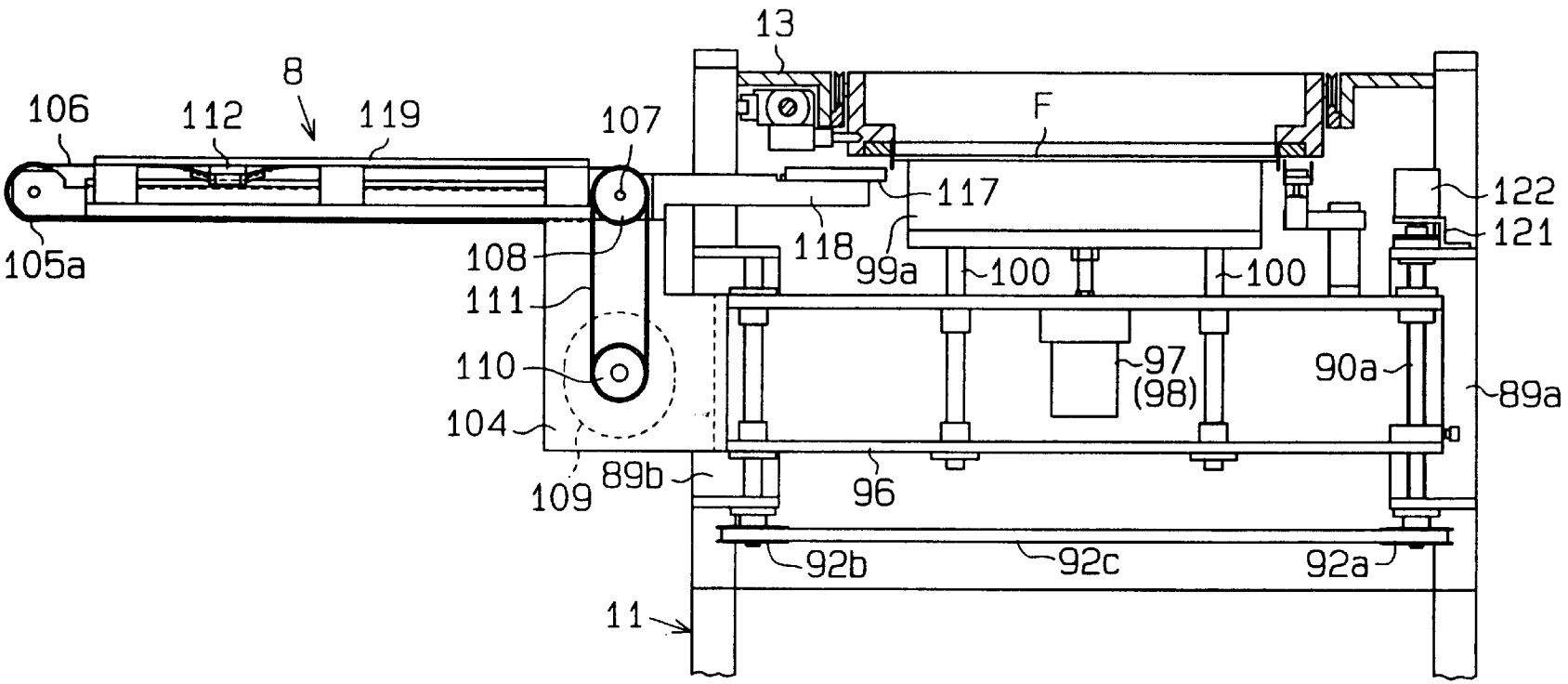
FIG. 19 is a front view showing a lamination pressing mechanism and a lock yarn inserting mechanism according to the second embodiment.

In addition to the advantages of the apparatus of FIGS. 1 to 17(*b*), the apparatus of FIGS. 18(*a*) to 19 has the following advantages.

To prepare for the insertion of the connection yarns z, the thickness of the lamination F is entered through the input device. Accordingly, the height of the support frame 96 is automatically adjusted by the servomotor 122 to a position corresponding to the thickness of the lamination F. Therefore, compared to a case where the height of the support frame 96 is controlled by manually operating the wheel 93, the preparation of the connection yarn insertion is easier for the operator.

When the connection yarns z, together with the insertion needles 40, are retracted, the lock yarn insertion needle 113 is lifted by the support frame 96 to a position that corresponds the lower side of the lamination F. In the first embodiment of FIGS. 1 to 17(*b*), the vertical position of the lock yarn insertion needle 113 is fixed. Therefore, when the connection yarns z are retracted, the needle 113 applies a force loosening the connection yarns z through the lock yarn P as shown in FIG. 18(*c*). Unlike the first embodiment of FIGS. 1 to 17(*b*) and 18(*c*), the needle 113 of the second embodiment is lifted as shown in FIG. 18(*b*) when the connection yarns z are retracted. The needle 113 of the second embodiment therefore does not apply a force that loosens the connection yarns z. As a result, the tightening force at the edge of the finished three-dimensional fabric is firm.

It should be apparent to those skilled in the art that the present invention may be embodied in many other specific forms without departing from the spirit or scope of the invention. Particularly, it should be understood that the invention may be embodied in the following forms.

If at least one of the conveying mechanism 2, the tension applying mechanism 4, the pressing mechanism 7 and the lock yarn inserting mechanism 8 is embodied in a connection yarn inserting apparatus, the time required for inserting connection yarns is reduced and the productivity is improved accordingly. In other words, even if all but one of the mechanisms have the prior art structure, the productivity will improve. Further, if all the mechanisms of the apparatus have the structures of the illustrated embodiments or structures having the same effects, the productivity is further improved.

In the illustrated embodiments, the stroke of the first pressing member (the press plate 85) and the second pressing member (the press blocks 99*a*, 99*b*) of the pressing mechanism 7 are discretely changed. However, the stroke of only one of the first and second pressing members may be discretely adjustable. In this case, the operation speed is slower compared to the case where the stroke of both pressing members are adjustable. However, the operation speed is faster than prior art apparatuses.

If the thickness of the lamination F varies discretely in its longitudinal direction, for example, if the lamination F has two thicknesses, the stopper 103 may have two engagement surfaces, each of which corresponds to one of the thicknesses of the lamination F. In this case, an actuator that has two stroke positions is used. As a result, the press blocks 99*a*, 99*b* have two standby positions at which the press blocks 99*a*, 99*b* engage the stopper 103. The press blocks 99*a*, 99*b* therefore have three different strokes. The same effect will be achieved by actuating two stoppers 103 that have different thicknesses by two actuators.

Instead of air cylinders for actuating the stoppers 88, 103, the stoppers 88, 103 may be actuated by solenoids.

In the illustrated embodiments, the table 10 is held horizontal. However, the tables 10 may be vertical or inclined.

The engagement hole 14*b*, which functions as the engagement portion of the table 10, may be formed as a through hole or other shape. The air cylinder 28, or the actuator, may be replaced by a solenoid. The piston rod 28*a* or the plunger of the solenoid, which serve as couplers, may indirectly engage the hole 14*b*. Specifically, a coupler that has a shape corresponding to the shape of the hole 14*b* may be attached to the piston rod 28*a* or the plunger.

A linear pulse motor may be used for moving the carrier tables 10. In this case, the stator is located on the guide rail 19 and the armature is fixed to the actuator (air cylinder 28). Using a linear pulse motor simplifies the structure of the apparatus compared to the servomotor 23 and the lead screw mechanism.

The mechanism for moving the carrier tables 10 includes the coupling members and the actuator, which move linearly. However, the mechanism may include an endless belt or a chain, which move circularly.

The actuator for the lock yarn insertion needle 113 may be a linear motor.

In the embodiment of FIGS. 18(a), 18(*b*) and 19, the lock yarn insertion needle 113 may be lifted while maintaining the pressure air supplied to the air cylinders 97, 98.

The lock yarn insertion needle 113 and its actuator may be lifted and lowered independently from the second pressing mechanism 81. When the insertion needles 40 are being retracted, the needle 113 and its actuator may be moved to a predetermined position without moving the second pressing mechanism 81. In this case, the second pressing mechanism 81 need not be lifted or lowered in every cycle of the insertion of the connection yarns z, which reduces the energy consumption.

The movable roller 79 of the tension applying mechanism 4 is moved by the lead screw mechanism, which is actuated by a motor, in the illustrated embodiments. Instead, the movable roller 79 may be moved by a rack and pinion mechanism or by a linear motor. The motor for moving the lead screw mechanism or the rack and pinion mechanism may be a motor other than a servomotor.

The support member 64 supporting the brake bars 66 is actuated by the air cylinder 61 through the lever 62 in the illustrated embodiments. Instead, the support member 64 may be secured to the piston rod 61*a* of the air cylinder 61.

A yarn guide may be provided in the path of the connection yarns z to prevent the yarns z from becoming tangled.

In the illustrated embodiments, the lamination F is formed with threads. However, the lamination F may be formed with a combination of threads and cloth.

Depending on the thickness and the fiber type of the lamination F, perforation by the perforation needles 55 may be omitted. In this case, the insertion needles 40 are directly inserted into the lamination F.

Therefore, the present examples and embodiments are to be considered as illustrative and not restrictive and the invention is not to be limited to the details given herein, but may be modified within the scope of the appended claims.

What is claimed is:

1. A connection yarn inserting apparatus for manufacturing three-dimensional fabric, wherein the apparatus inserts a connection yarn into a lamination, which is formed by laminating a plurality of fiber layers and has fibers extending in at least two different directions, in a direction transverse to the fiber layers, the apparatus comprising:

a frame for holding the lamination;

a needle for inserting the connection yarn into the lamination held by the frame, wherein the needle moves in an advancement direction and a retraction direction, the insertion needle being moved between a standby position, where the insertion needle is separated from the lamination, and an operation position, where the insertion needle penetrates the lamination;

a first pressing member located at the same side of the lamination as the standby position of the insertion needle, wherein the first pressing member is moved in the moving direction of the insertion needle to and from the vicinity of an insertion location of the insertion needle;

a first air cylinder for moving the first pressing member between an operational position, where the first pressing member engages the lamination in the vicinity of an insertion location of the insertion needle and presses the lamination in the advancing direction of the insertion needle, and a standby position, where the first pressing member is separated from the lamination;

a second pressing member located at the opposite side of the lamination relative to the first pressing member, wherein the second pressing member is moved in the moving direction of the insertion needle to and from the vicinity of the insertion location of the insertion needle;

a second air cylinder for moving the second pressing member between an operational position, where the second pressing member engages the lamination and presses the lamination in the retraction direction of the insertion needle, and a standby position, at which the second pressing member is separated from the lamination;

a stopper that is engageable with a piston rod of at least one of the first and second air cylinders, wherein, when the stopper is engaged with the piston rod, the stopper limits the movement of the piston rod in the retraction direction to directly vary the stroke of the piston rod and the corresponding pressing member; and an actuator for actuating the stopper.

2. The connection yarn inserting apparatus according to claim 1, wherein the strokes of the first and second pressing members are discretely variable.

3. The connection yarn inserting apparatus according to claim 1, wherein the second pressing member and the second air cylinder are supported by a support frame, and wherein the support frame is supported to be movable in a direction perpendicular to the lamination.

4. The connection yarn inserting apparatus according to claim 3, wherein the support frame is supported by a lead screw nut of a lead screw mechanism to be lifted and lowered, and wherein the screw shaft of the lead screw mechanism is coupled to a manually operated handle.

5. The connection yarn inserting apparatus according to claim 4, wherein, when the insertion needle is at the operation position, an eye of the insertion needle is located at the opposite side of the lamination from the standby position and the insertion needle forms a loop of the connection yarn, wherein the loop is connected to the insertion needle; and wherein the apparatus further includes a lock yarn needle for inserting a lock yarn into the loop and an actuation mechanism for actuating the lock yarn needle.

6. A connection yarn inserting apparatus for manufacturing three-dimensional fabric, wherein the apparatus inserts a connection yarn into a lamination, which is formed by laminating a plurality of fiber layers and has fibers extending in at least two different directions, along a direction crossing the fiber layers, the apparatus comprising:

a first feeding mechanism for feeding the connection yarn;

a needle for inserting the connection yarn into the lamination;

a tension applying mechanism located in the path of the connection yarn, which extends from the first feeding mechanism to the insertion needle, wherein the tension applying mechanism applies tension to the connection yarn; and a brake device located closer to the first feeding mechanism than the tension applying mechanism, wherein, when the tension applying mechanism applies tension to the connection yarn, the brake device is actuated to hold the connection yarn;

wherein the tension applying mechanism includes:

two fixed rollers, the axes of which are perpendicular to the connection yarn;

a movable roller, wherein the movable roller is moved in a direction perpendicular to a plane that includes the axes of the fixed rollers; and an actuation mechanism including an air cylinder and a moving device, which has a motor as a drive source, wherein the actuation mechanism reciprocates the movable roller to change the length of the connection yarn between the two fixed rollers.

7. A connection yarn inserting apparatus for manufacturing three-dimensional fabric, wherein the apparatus inserts a connection yarn into one of a plurality of laminations, each of which is formed by laminating a plurality of fiber layers and has fibers extending in at least two different directions, in a direction transverse to the fiber layers, the apparatus comprising:

frames for holding the laminations, wherein one of the frames holds an unprocessed lamination, and one of the frames holds a processed lamination;

at least two carrier tables for supporting the frames, respectively;

a guiding mechanism for guiding the carrier tables, wherein the guiding mechanism simultaneously guides the carrier tables to move in a conveying direction; and a conveying device for moving the carrier tables by a predetermined pitch such that the laminations consecutively pass a position at which the connection yarn is inserted.

8. The connection yarn inserting apparatus according to claim 7, wherein each carrier table has a coupler for joining the carrier tables to one another.

9. The connection yarn inserting apparatus according to claim 7, wherein the conveying device includes:

an engagement portion provided in the carrier table;

a coupling member that engages the engagement portion of the carrier table; and an actuator for moving the coupling member between an engagement position, at which the coupling member engages the engagement portion, and a standby position, at which the coupling member is separated from the engagement portion;

wherein the coupling member moves in the conveying direction within a predetermined range that is greater than the corresponding length of each carrier table.

10. The connection yarn inserting apparatus according to claim 7, wherein the guiding mechanism guides the carrier table such that each carrier table is horizontal.

11. The connection yarn inserting apparatus according to claim 9, further comprising a lead screw mechanism extending in the conveying direction, wherein the lead screw mechanism is actuated by a servomotor, and wherein the actuator is fixed to a lead screw nut of the lead screw mechanism.

12. The connection yarn inserting mechanism according to claim 9, wherein the engagement portion is a hole formed in the carrier table, and wherein the actuator is either an air cylinder or a solenoid.

13. A connection yarn inserting apparatus for manufacturing three-dimensional fabric, wherein the apparatus inserts connection yarns into a lamination, which is formed by laminating a plurality of fiber layers and has fibers extending in at least two different directions, in a direction transverse to the fiber layers, the apparatus comprising:

a frame for holding the lamination;

a row of needles for simultaneously inserting the connection yarns into the lamination held by the frame, each needle having an eye, wherein, when the insertion needles are at an operation position, the eye of each insertion needle has been passed through the lamination and the each insertion needle forms a loop of the associated connection yarn, wherein the loop is connected to the associated insertion needle;

a lock yarn needle movable along the row of the insertion needles, wherein the lock yarn needle includes a hooking member for hooking a lock yarn and is moved between an operational position, at which the lock yarn needle is received by the loops of the connection yarns to insert the lock yarn into the loops, and a standby position, at which the lock yarn needle is outside the loops;

a plurality of pulleys;

an endless belt engaging the pulleys;

a motor for actuating the pulleys to move the belt along a running path;

wherein a segment of the belt is parallel to the row of the insertion needles, wherein the segment is longer than the distance that the hooking member of the lock yarn needle moves to insert the lock yarn to the loops; and a support member fixed to the belt for supporting the lock yarn needle, wherein the support member moves the lock yarn needle between the operational position and the standby position as the belt runs.

14. A connection yarn inserting apparatus for manufacturing three-dimensional fabric, wherein the apparatus inserts connection yarns into a lamination, which is formed by laminating a plurality of fiber layers and has fibers arranged in at least two different directions, in a direction transverse to the fiber layers, the apparatus comprising:

a frame for holding the lamination;

a row of insertion needles for simultaneously inserting the connection yarns into the lamination held by the frame;

a support body movable in a direction perpendicular to the lamination held by the frame;

a row of perforation needles supported by the support body, wherein the perforation needles are arranged at a pitch corresponding to the insertion needles; and an actuation mechanism for moving the perforation needles between a standby position, where the perforation needles are separated from the lamination, and an operational position, where the perforation needles penetrate the lamination;

wherein the speed of the actuation mechanism is controlled such that the perforation needles are moved relatively quickly when the perforation needles are separated from the lamination and are moved relatively slowly when the perforation needles engage the lamination.

15. A connection yarn inserting apparatus for manufacturing three-dimensional fabric, wherein the apparatus inserts connection yarns into a lamination, which is formed by laminating a plurality of fiber layers and has fibers extending in at least two different directions, in a direction transverse to the fiber layers, the apparatus comprising:

a frame for holding the lamination;

a row of needles for simultaneously inserting the connection yarns into the lamination held by the frame, each needle having an eye, wherein, when the insertion needles are at an operation position, the eye of each insertion needle has been passed through the lamination and the each insertion needle forms a loop of the associated connection yarn, wherein the loop is connected to the associated insertion needle;

a lock yarn needle for inserting a lock yarn through the loops of the connection yarns;

an actuation mechanism for actuating the lock yarn needle;

a support frame for supporting the lock yarn and the actuation mechanism, wherein the support frame is moved in the moving direction of the lock yarn; and a driving device, wherein, when the insertion needles are being retracted, the driving device moves the support frame until the lock yarn needle is on a side of the lamination that is opposite to the side from which the insertion needles are inserted into the lamination.

* * * * *